US012310516B2

(12) United States Patent
Pryor et al.

(10) Patent No.: US 12,310,516 B2
(45) Date of Patent: May 27, 2025

(54) MODULAR STORAGE SYSTEM FOR STORAGE CONTAINERS

(71) Applicant: Williams Scotsman, Inc., Baltimore, MD (US)

(72) Inventors: Steven Pryor, St Augustine, FL (US); Jodi Shaw, Tempe, AZ (US); Brian Kavanagh, Lutherville, MD (US); Lawrence Berger, Jacksonville, FL (US); Gregg Sheddy, Shrewsbury, PA (US); Corey Salemi, Baltimore, MD (US); Jeff Bowers, Phoenix, AZ (US); Matt Mangosing, Chandler, AZ (US); Michael Elling Zimmerman, Jacksonville, FL (US)

(73) Assignee: WILLIAMS SCOTSMAN, INC., Baltimore, MD (US)

( * ) Notice: Subject to any disclaimer, the term of this patent is extended or adjusted under 35 U.S.C. 154(b) by 0 days.

(21) Appl. No.: 18/236,629

(22) Filed: Aug. 22, 2023

(65) Prior Publication Data

US 2024/0065458 A1 Feb. 29, 2024

Related U.S. Application Data

(60) Provisional application No. 63/401,802, filed on Aug. 29, 2022.

(51) Int. Cl.
*A47F 5/00* (2006.01)
*A47F 5/08* (2006.01)

(52) U.S. Cl.
CPC ..... *A47F 5/0087* (2013.01); *A47F 5/0823* (2013.01); *A47F 5/0892* (2013.01)

(58) Field of Classification Search
CPC .... A47F 5/0087; A47F 5/0823; A47F 5/0892; A47F 5/0838; A47F 5/0846;
(Continued)

(56) References Cited

U.S. PATENT DOCUMENTS 3,151,576 A 10/1964 Patterson
5,332,108 A 7/1994 Blass
(Continued)

FOREIGN PATENT DOCUMENTS

WO WO-2024050276 A2 * 3/2024 ..... A47B 46/005

OTHER PUBLICATIONS

International Search Report and Written Opinion, PCT/US2023/072824, dated Mar. 15, 2024, 13 pages.

*Primary Examiner* — Jennifer E. Novosad
(74) *Attorney, Agent, or Firm* — FOLEY & LARDNER LLP

(57) ABSTRACT

A storage system is configured for adjustable suspension from fixed points on a vertical wall, such as from fixed tie-down loops that are rigidly and permanently affixed to the wall of a shipping container. The system includes a plurality of pivotable arms that may have attached thereto shelves or other planar panels and may be variably positioned to provide vertical storage panels, flat work surfaces (such as a desk surface), or upwardly angled support posts, for example, for hanging items such as cables, ropes, pipe sections, and the like. A suspension assembly for the storage system enables hanging suspension of the system at any desired location along the length of the vertical wall, despite the location of the fixed loops from which the system is ultimately suspended.

21 Claims, 25 Drawing Sheets

(58) Field of Classification Search
CPC ..... A47F 5/0853; A47B 96/02; A47B 47/00; A47B 47/02; A47B 57/04; A47B 57/045; A47B 96/028; A47B 96/06; A47B 96/061; A47B 96/067
USPC ..... 211/150, 113, 116, 87.01; 220/1.5
See application file for complete search history.

(56) References Cited

U.S. PATENT DOCUMENTS 5,472,103 A * 12/1995 Merl ..... A47B 47/022 211/187
5,485,932 A * 1/1996 Romm ..... H02G 3/28 248/214
5,509,541 A * 4/1996 Merl ..... A47B 57/42 211/208
6,669,154 B1 * 12/2003 Remmers ..... A47F 5/08 248/220.21
7,296,697 B2 11/2007 Costa et al.
7,401,705 B2 * 7/2008 Craft ..... A47B 96/00 211/113
7,407,060 B2 * 8/2008 Swartz ..... A47B 96/067 211/94.01
D585,730 S * 2/2009 Fernandez ..... D8/387
7,494,019 B2 * 2/2009 Kessell ..... A47B 57/06 211/186
7,900,783 B2 * 3/2011 Fernandez ..... F16B 25/0057 211/90.03
8,210,368 B2 * 7/2012 Schwartzkopf ..... A47F 5/101 211/103
8,333,158 B2 * 12/2012 Wise ..... A47B 57/20 108/134
8,434,629 B2 * 5/2013 Fernandez ..... A47B 96/067 211/94.01
8,646,624 B2 * 2/2014 Fernandez ..... A47B 57/42 211/90.03
8,967,402 B2 * 3/2015 Pintur ..... A47B 47/022 211/DIG. 1
8,998,009 B2 * 4/2015 Kim ..... A47B 96/067 211/175
9,770,122 B2 * 9/2017 Gonzalez ..... A47B 95/008
9,936,825 B1 * 4/2018 Lindblom ..... A47F 5/0087
10,021,972 B1 * 7/2018 Robinson ..... A47B 57/30
10,351,343 B2 * 7/2019 Neu ..... B65G 1/023
10,617,231 B2 * 4/2020 Gonzalez ..... A47B 57/485
11,369,215 B2 * 6/2022 Obitts ..... A47B 96/07
11,849,839 B2 * 12/2023 Nilsson ..... A47B 57/52
2003/0234231 A1 12/2003 Rowe
2004/0011755 A1 * 1/2004 Wood ..... A47F 5/103 211/187
2005/0145147 A1 * 7/2005 Costa ..... A47B 96/028 211/90.03
2005/0247651 A1 11/2005 Craft
2007/0221595 A1 * 9/2007 Chen ..... A47B 95/008 211/207
2008/0011920 A1 1/2008 Sloan
2008/0237426 A1 * 10/2008 Walters ..... H04N 5/64 248/304
2010/0300999 A1 * 12/2010 Schwartzkopf ..... A47F 5/101 211/104
2012/0000872 A1 * 1/2012 Troyner ..... A47B 47/021 211/153
2012/0255925 A1 * 10/2012 Fernandez ..... A47B 96/067 211/134
2018/0153316 A1 * 6/2018 Buck ..... A47F 5/103
2020/0000246 A1 1/2020 Gonzalez et al.
2021/0080127 A1 3/2021 Roverato
2021/0330094 A1 * 10/2021 Smedley ..... A47F 5/0043
2024/0065458 A1 * 2/2024 Pryor ..... A47F 5/0087

* cited by examiner

| Shelf Support Orientation | Shelf Support Connection / Upright Connection | | | Upright Connection Used | Shelf Support Connection Unused |
|---|---|---|---|---|---|
|  | 1/A | 2/B | 3/NC* | C | 3 |
|  | 1/A | 2/NC | 3/B | C | 2 |
|  | 1/A | 2/C | 3/NC | B | 3 |

*NC = Not Connected

MODULAR STORAGE SYSTEM FOR STORAGE CONTAINERS

CROSS-REFERENCE TO RELATED APPLICATIONS

This application is related to, and claims priority from, U.S. Provisional Application No. 63/401,802, filed Aug. 29, 2022, entitled "Modular Shelving System," the entirety of which is hereby incorporated by reference.

TECHNICAL FIELD

This disclosure relates generally to storage and shelving systems, and more particularly to a modular storage system configured for attachment to the interior of a storage container, such as a metal shipping container or modular building.

BRIEF SUMMARY OF THE DISCLOSURE

A modular storage system is configured for mounting inside of a space, such as on the interior of a metal container, such as a shipping container or a modular building. Such a modular storage system configured in accordance with at least certain aspects of this disclosure may provide one or more of the following features: (i) brackets and/or hooks for engaging a container wall enabling suspended mounting of the modular storage system from the wall of the container; (ii) uprights on the modular storage system enabling a quick-install, hang-and-drop installation; (iii) optional multi-position arms and shelves/platforms enabling varied system configurations for storage of varied items; (iv) frame uprights and spacers having wire raceways for placement and routing of cables, such as metal clad cables; (v) an optional arm and platform system that enables the arms to be used without the shelves/platforms as a holder for hollow items (such as pipes or sections of PVC), or as an angled storage holder for cables, cords, or similarly configured items, and shelf/platform panels configured to selectively function as a shelf in a horizontal position or a peg board configured to hold items, such as tools, in a vertical position; (vi) if installed, arms that may be quickly set into different positions through the use of threaded knobs or quick release pins; (vii) an optional shelf, such as a lower shelf of the modular storage system, configured to function as a desk/worksurface when in the horizontal position in order to create a workspace within the container in which the modular storage system is installed; (viii) a frame spacer configuration that allows for the selective addition of other panels for storage of further items, such as mesh panels on which hooked items may be hung for storage; and (ix) a rear, optionally magnetized bumper/offset configured to keep the uprights of the modular storage system from swinging front to back and side to side, and which will allow for transportation to an intended site when installed in the container.

The modular storage system described herein is particularly adaptable for installation and use in a shipping or transportable storage container. The storage system can be configured to provide a variety of storage and worksurfaces that may be modified to adapt to a user's particular storage and working needs while maintaining ease of installation and reconfiguration, and yet a rigid, secured attachment of the storage system when configured for use. Particular aspects of this disclosure allow for quick hang-and-drop installation at a user's desired location along the container wall.

In an exemplary configuration, the modular storage system described herein may suspend a horizontal bar from a container wall as the primary suspension member, and the entirety of the storage system may be suspended from the horizontal bar, thus enabling the system to be laterally positioned along the container wall at varied locations, without regard to the locations of either corrugations in the container wall or eye-hooks (i.e., rigid loops or cargo rings for lashing cargo) that are affixed to the container wall.

BRIEF DESCRIPTION OF THE DRAWINGS

The accompanying drawings are incorporated herein and form a part of the specification, wherein.

In the drawings, like reference numbers generally indicate identical or similar elements. Additionally, the left-most digit(s) of a reference number generally identifies the drawing in which the reference number first appears.

DETAILED DESCRIPTION OF THE EMBODIMENTS

The following description of particular embodiment(s) is set out to enable one to practice one or more implementations of this disclosure. The following description is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present disclosure. Those skilled in the art should also realize that such equivalent assemblies do not depart from the spirit and scope of the disclosure in its broadest form.

Descriptions of well-known functions and structures are omitted to enhance clarity and conciseness. The terminology used herein is for the purpose of describing particular embodiments only and is not intended to be limiting of the present disclosure. As used herein, the singular forms "a," "an," and "the" are intended to include the plural forms as well, unless the context clearly indicates otherwise. Furthermore, the use of the terms a, an, etc. does not denote a limitation of quantity, but rather denotes the presence of at least one of the referenced items.

The use of the terms "first," "second," and the like does not imply any particular order, but they are included to identify individual elements. Moreover, the use of the terms first, second, etc. does not denote any order of importance, but rather the terms first, second, etc. are used to distinguish one element from another. It will be further understood that the terms "comprises" and/or "comprising," or "includes" and/or "including," when used in this specification, specify the presence of stated features, regions, integers, steps, operations, elements, and/or components, but do not preclude the presence or addition of one or more other features, regions, integers, steps, operations, elements, components, and/or groups thereof.

Although some features may be described with respect to individual exemplary embodiments, aspects need not be limited thereto such that features from one or more exemplary embodiments may be combinable with other features from one or more exemplary embodiments.

Figure 1:
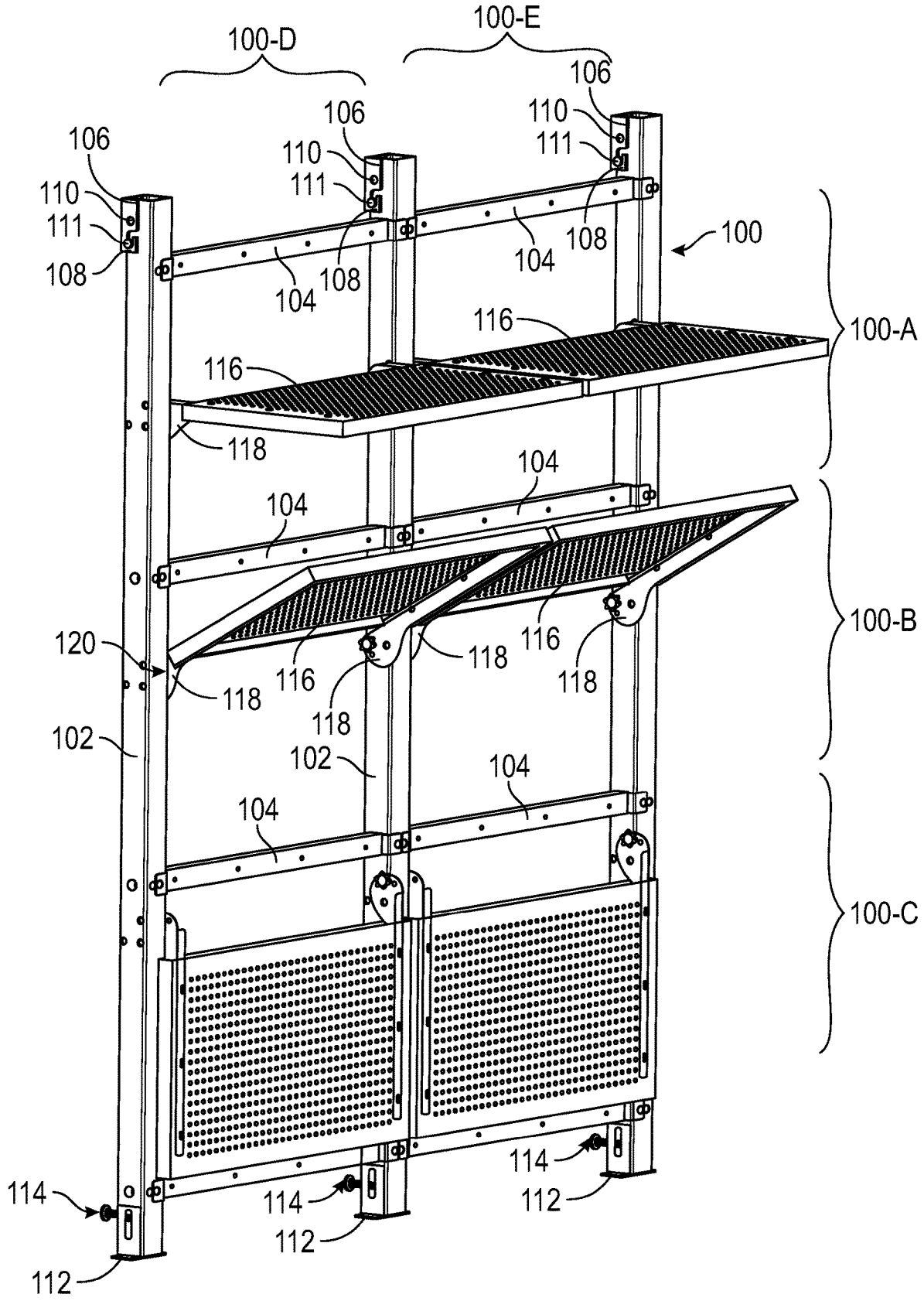
FIG. 1 illustrates a storage system, according to some embodiments.

FIG. 1 illustrates a storage system 100, according to some embodiments. Storage system 100 includes a frame defined by a plurality of vertical uprights 102 and horizontally oriented cross braces 104 extending between adjacent vertical uprights 102. A plurality of hanging brackets 106 can be affixed to an interior wall of a container (such as a shipping container), such as by way of bolts, screws, or similarly configured fasteners. Each such hanging bracket 106 includes a side hole 204 that accepts a horizontally extending bolt, pin, or rod 110, and a hook portion 108 at the bottom of the hanging bracket 106 that accepts a second horizontally extending bolt, pin, or rod 111. Horizontally extending bolt, pin, or rod 110, extending through the top portion of the vertical upright 102, is configured to engage the side hole 204 for hanging each vertical upright 102, which can then drop into the hook portion 108 of hanging bracket 106. Thus, the storage system 100 can suspend in a hanging fashion from the wall of the container at bolt, pin, or rod 110 while being stabilized by the second bolt, pin, or rod 111 in the hanging bracket 106.

In certain configurations, adjustable footers 112 may be positioned at the bottom of each upright 102 and may receive bolts, screws, or other connectors to enable fixed attachment of the bottom of storage system 100 to the floor of the container. For those instances in which adjustable footers 112 are not fixed to the floor of the container, swivel leveling mounts 114 may extend rearward from each upright 102 to prevent the uprights 102 from swinging and potentially slamming back against the container wall. Still further, a plurality of optional variably positionable shelves 116 can be positioned on optional shelf supports 118, each of which shelf support 118 can be pivotably mounted to an upright 102. Shelves 116 may be positioned horizontally to provide a worksurface or a horizontal storage shelf (shown in section 100-A of FIG. 1), in an angled position (shown in section 100-B of FIG. 1), or vertically to provide a pegboard panel (shown in section 100-C of FIG. 1), for example.

Uprights 102 can be configured to enable expansion of the storage system 100, in a modular fashion, by adding one section at a time. For example, as shown in FIG. 1, a first section 100-D of storage system 100 exists between the left-most and center uprights 102. A second section 100-E having additional cross braces 104, optional shelves 116, and the right-most upright 102 can be added after the first section 100-D of storage system 100 has been assembled and installed inside of the container.

Figure 2C:
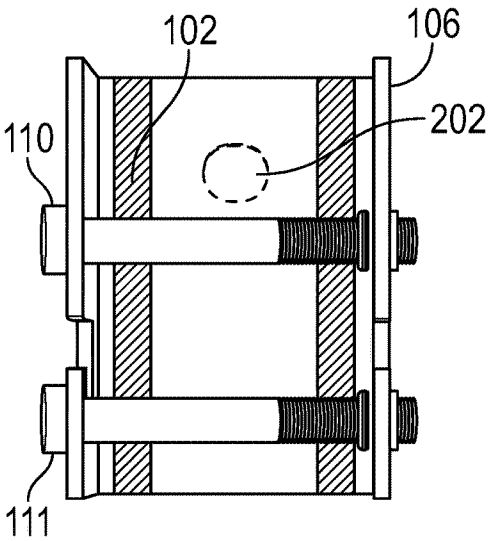
FIG. 2C illustrates a detailed front view of a hanging bracket bolted to an upright, according to some embodiments.
Figure 2B:
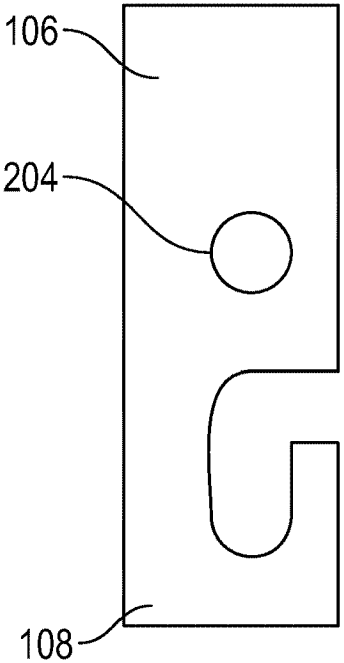
FIG. 2B illustrates a side view of a hanging bracket of the storage system, according to some embodiments.
Figure 2A:
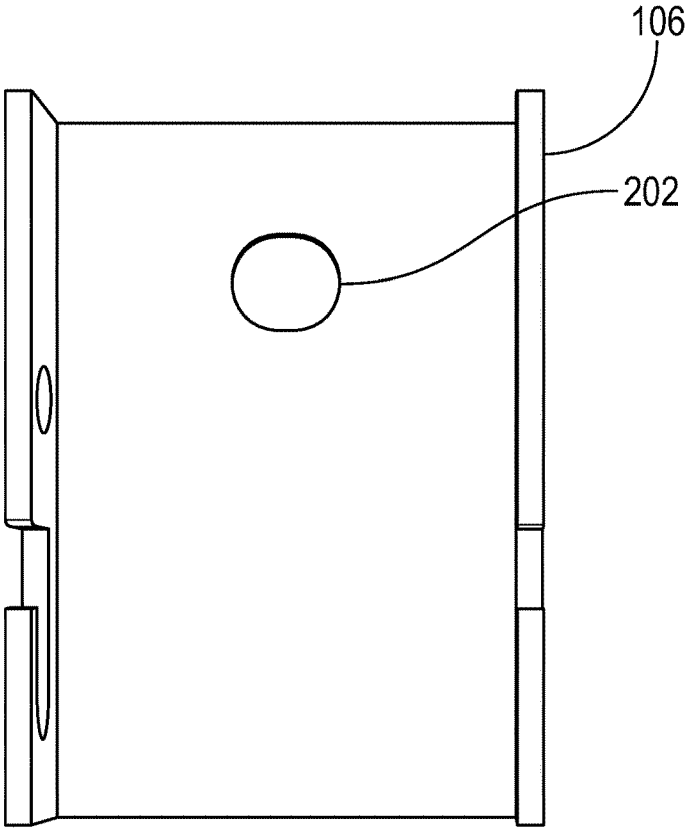
FIG. 2A illustrates a front view of a hanging bracket of the storage system, according to some embodiments.

FIGS. 2A and 2B illustrate a front and side view, respectively, of hanging bracket 106 of storage system 100, according to some embodiments. Hanging brackets 106 may mount to typically 2" structural cross support members along the top of the container in which storage system 100 is installed. Hanging brackets 106 may be configured to allow bolt-through installation, or alternatively, may be welded to the container wall to hold the hanging brackets 106 in place.

As shown in FIG. 2A, a front hole 202, such as an obround hole, allows for bolt-through application of hanging bracket 106 to the container wall. Likewise, the hook portion 108 of each hanging bracket 106 allows for quick hanging of uprights 102 of storage system 100.

As shown in FIG. 2B, a side hole 204, extending through the sidewalls of each hanging bracket 106, aligns with holes in the top of each upright 102 and may receive therethrough a bolt, pin, rod, or similar element (such as bolt, pin, or rod 110, as shown in FIG. 2C) to prevent unwanted lifting of the top of storage system 100 after it has been installed onto hanging brackets 106.

FIG. 2C illustrates a detailed front view of hanging bracket 106 bolted to upright 102, according to some embodiments. As shown in FIG. 2C, the opening in hook portion 108 at the bottom of the hanging bracket 106 can accept a second bolt, pin, or rod, such as a bolt, pin, or rod 111, installed on or in upright 102, for hanging the upright 102 from the hanging bracket 106.

Figure 3:
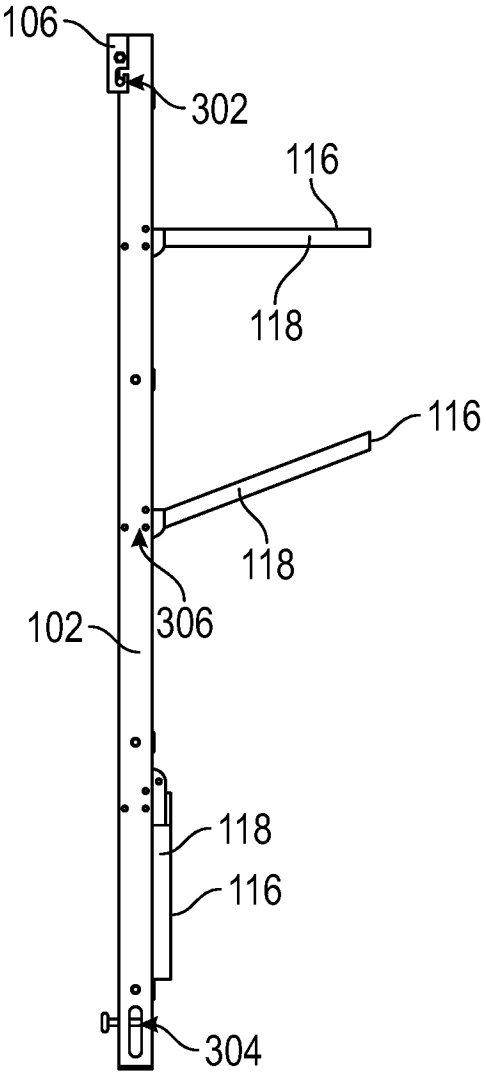
FIG. 3 illustrates a side view of the storage system, according to some embodiments.

FIG. 3 illustrates a side view of the storage system 100, according to some embodiments. As shown in FIG. 3, the top of each upright 102 defines a bracket connection point 302 for at least initially pivotably connecting the upright 102 to hanging bracket 106, and optionally thereafter receiving a bolt, pin, rod, or other element (such as bolt, pin, or rod 110) to prevent upright 102 (and thus all of storage system 100) from swinging or pivoting. Similarly, the bottom of each upright 102 that receives adjustable footer 112 may optionally define a footer connection point 304. Finally, for each shelf 116 (and more particularly for each shelf support 118), a multi-hole pattern 306 (discussed in greater detail below) is provided in the sidewall of each upright 102 that allows for independently adjustable positioning, such as angled, horizontal, and vertical positioning, of each shelf 116 of the storage system 100.

Figure 4B:
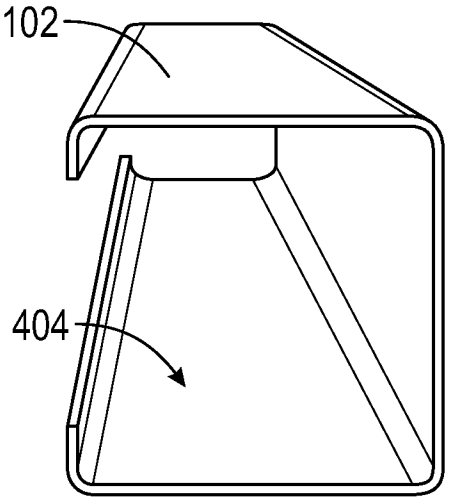
FIG. 4B illustrates a bottom-inside view of the vertical upright, according to some embodiments.
Figure 4A:
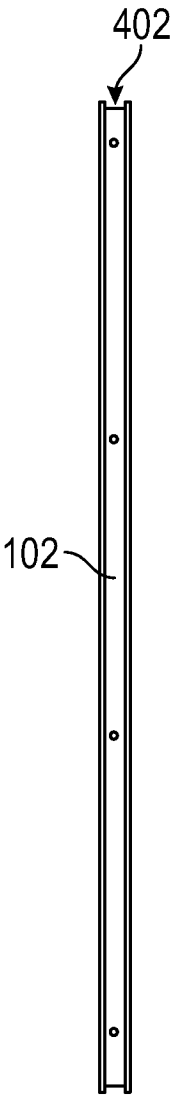
FIG. 4A illustrates a rear view of a vertical upright of the storage system, according to some embodiments.

FIGS. 4A and 4B illustrate a rear and inside view, respectively, of vertical upright 102 of storage system 100, according to some embodiments. In FIG. 4A, each upright 102 defines a hollow U-channel 402 along the back of upright 102. Further, as shown in the bottom-inside view of the vertical upright 102 of FIG. 4B, the U-channel 402 of each upright 102 defines an interior track 404 having sufficient clearance to receive metal clad cable systems to enable cables (such as power, audio, video, optical, communications, and other such cables) to be run through each upright 102. Likewise, each such upright 102 optionally includes one or more entry points (not shown) along a sidewall of the upright 102 to enable insertion of such cables that extend horizontally, e.g., along cross braces 104, between adjacent uprights 102.

Figure 5A:
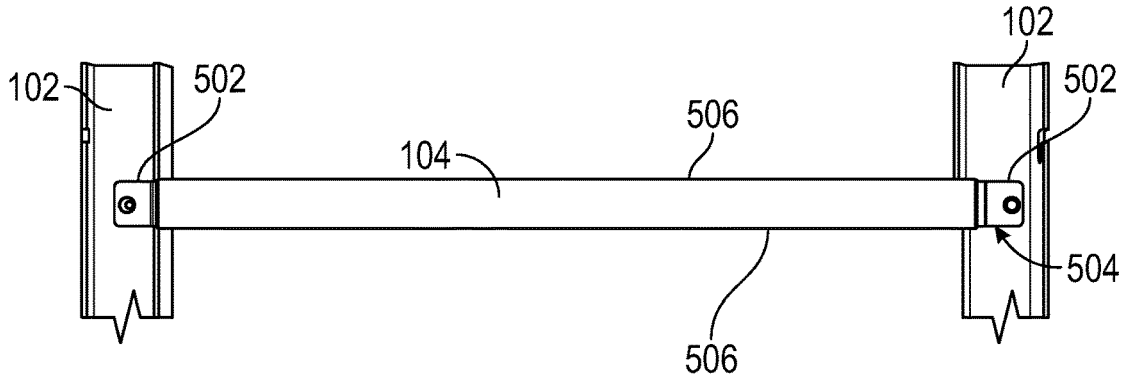
FIG. 5A illustrates a front view of a cross brace as installed between two uprights of the storage system, according to some embodiments.
Figure 5B:
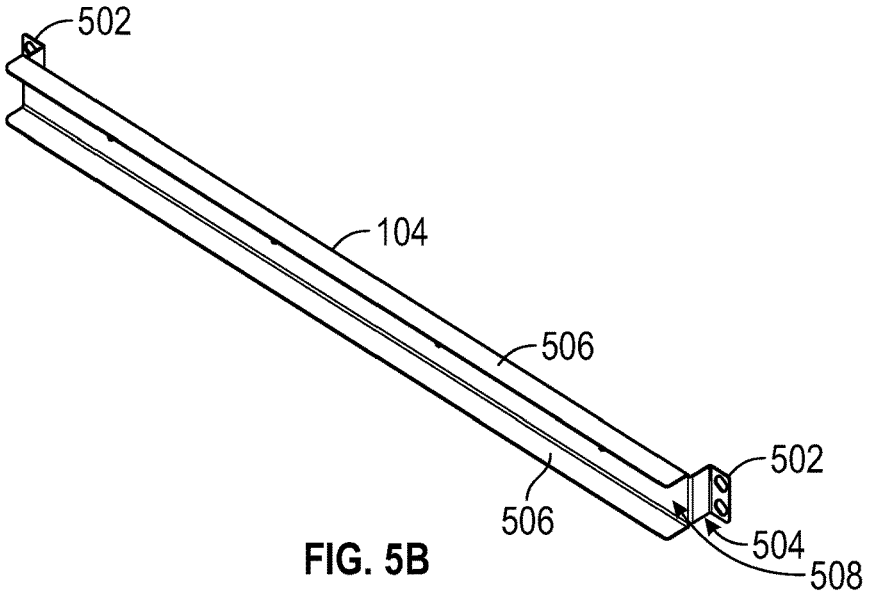
FIG. 5B illustrates a perspective view of a cross brace, according to some embodiments.
Figure 5C:
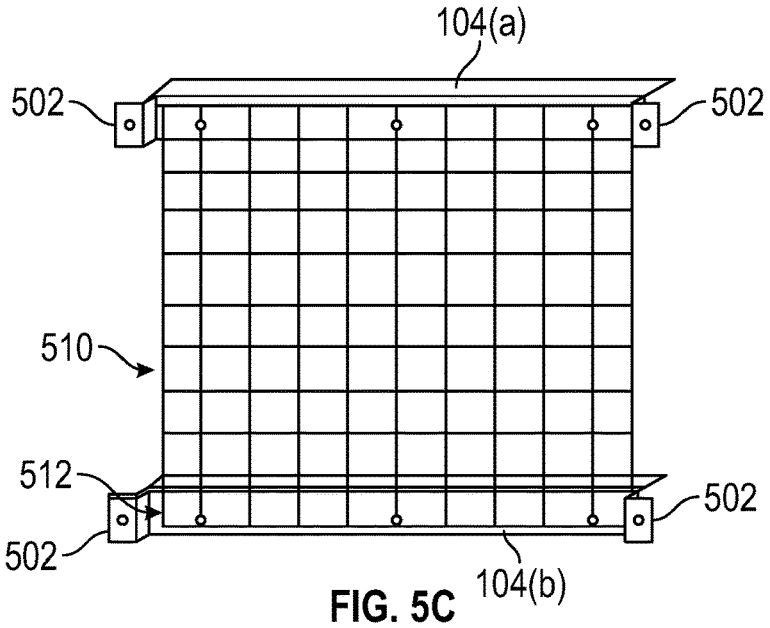
FIG. 5C illustrates another front view of cross braces, with a vertical panel in an inset area between an upper cross brace and a lower cross brace, and between adjacent uprights, of the storage system, according to some embodiments.

FIGS. 5A-5C show detailed views of cross braces 104 of storage system 100. Referring back to FIG. 1, storage system 100 preferably includes at least two cross braces 104, one along the top and one along the bottom of storage system 100. Storage system 100 may alternatively be configured with one or more intermediate cross braces 104 positioned between and parallel to the top and bottom cross braces 104. In any case, vertical panels may be sized to fit between adjacent cross braces, as described below for FIG. 5C.

FIG. 5A illustrates a front view of cross brace 104 as installed between two uprights 102 of storage system 100, according to some embodiments. As shown in FIG. 5A, each end of cross brace 104 has a flat connecting tab 502 with openings to receive a fastener (such as a screw or bolt) for affixing each cross brace 104 to the front of two adjacent uprights 102.

FIG. 5B illustrates a top and side view of cross brace 104, according to some embodiments. As shown in FIG. 5B, tab 502, which is configured, in some embodiments, to fasten at the front of upright 102, has an angled portion that allows for cross brace 104 to be set back from the front of upright 102 (see set-back area 504). Each of the top and bottom of cross brace 104 has a flange 506, the flanges 506 projecting toward the back of storage system 100 and serving to strengthen the cross brace 104 along its length between two adjacent uprights 102. Flanges 506 additionally define the channel 508 along the back surface of cross brace 104 that extends between the adjacent uprights 102. Channel 508 can serve as a pathway or raceway for cabling, such as metal cased wire, similarly to U-channel 402 of upright 102.

FIG. 5C illustrates another front view of cross braces 104, with insertion of vertical panels 510 in an inset area (shown generally at 512) between an upper cross brace 104(*a*) and a lower cross brace 104(*b*), and between adjacent uprights 102, of the storage system 100, according to some embodiments. As illustrated in FIG. 5C, the set-back area 504 shown in FIG. 5B in turn defines the inset area 512 in front of cross brace 104, allowing for the insertion of vertical panels 510, such as a vertical mesh media panel. As further illustrated in FIG. 5C, a vertical panel 510 may be inserted into the area defined between an upper cross brace 104(*a*) and lower cross brace 104(*b*), and between adjacent uprights 102, without such vertical panel 510 extending outward from the fronts of each vertical upright 102. Such a set-back configuration prevents vertical panels 510 from encumbering the movement of shelf supports 118.

Figure 6:
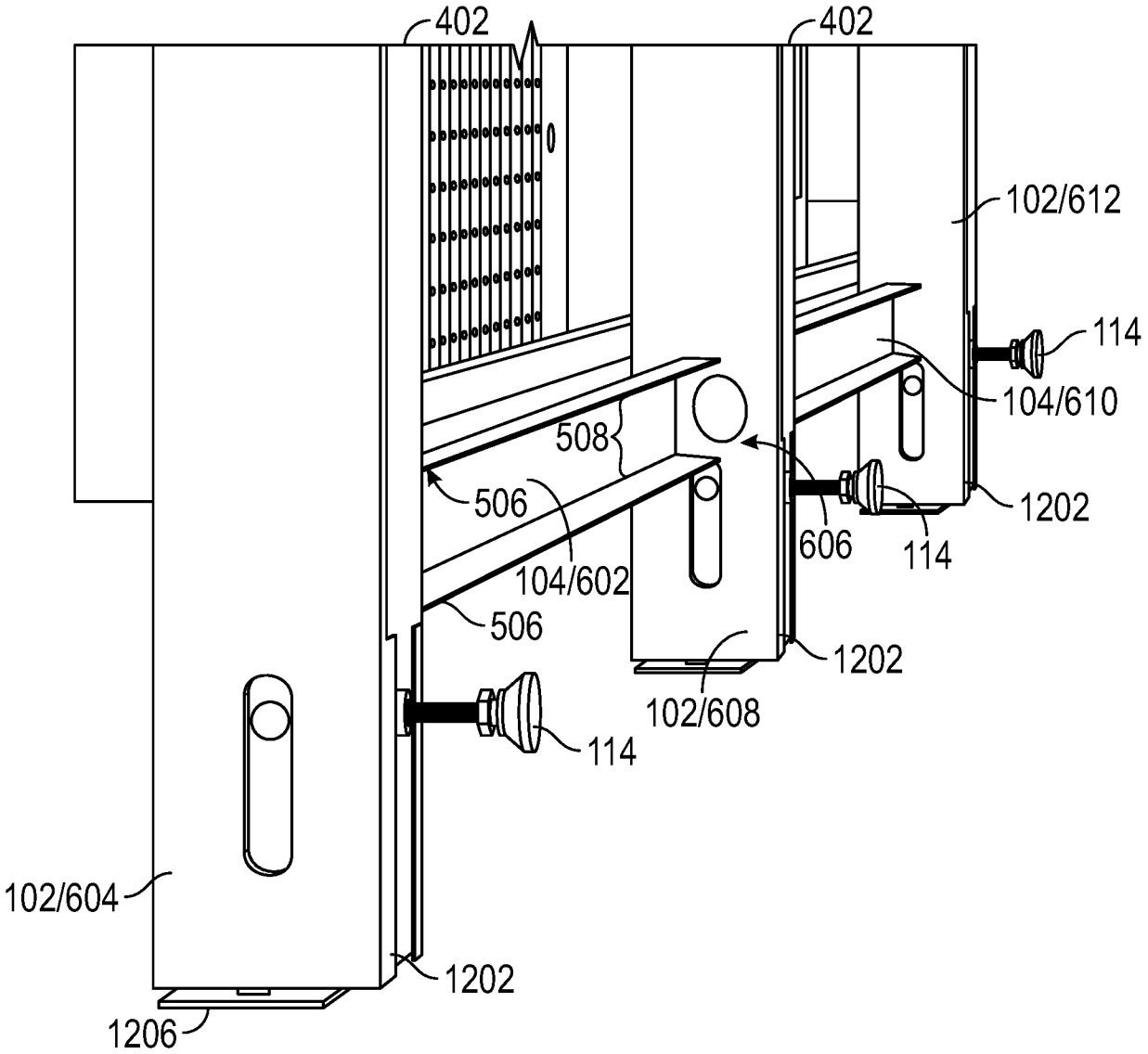
FIG. 6 illustrates a rear perspective view of a bottom portion of the storage system, according to some embodiments.

FIG. 6 illustrates the channel 508 on the back of each cross brace 104 and its relationship to the U-channel 402 of the uprights 102 of the storage system 100, according to some embodiments. As shown in FIG. 6, the ends of the channel 508 on the back of a first cross brace 602 (akin to cross brace 104) may align with an opening (not shown) in a first upright 604 (akin to upright 102) to allow running of cabling from the U-channel 402 of the first upright 604/102, through the channel 508 (defined by flanges 506), along the back of first cross brace 602, and into opening 606 of the second upright 608 (akin to upright 102). The cabling may then turn to extend vertically within the U-channel 402 of the second upright 608/102 or continue horizontally along the second cross brace 610/104 to a third upright 612 (akin to upright 102).

Figure 7A:
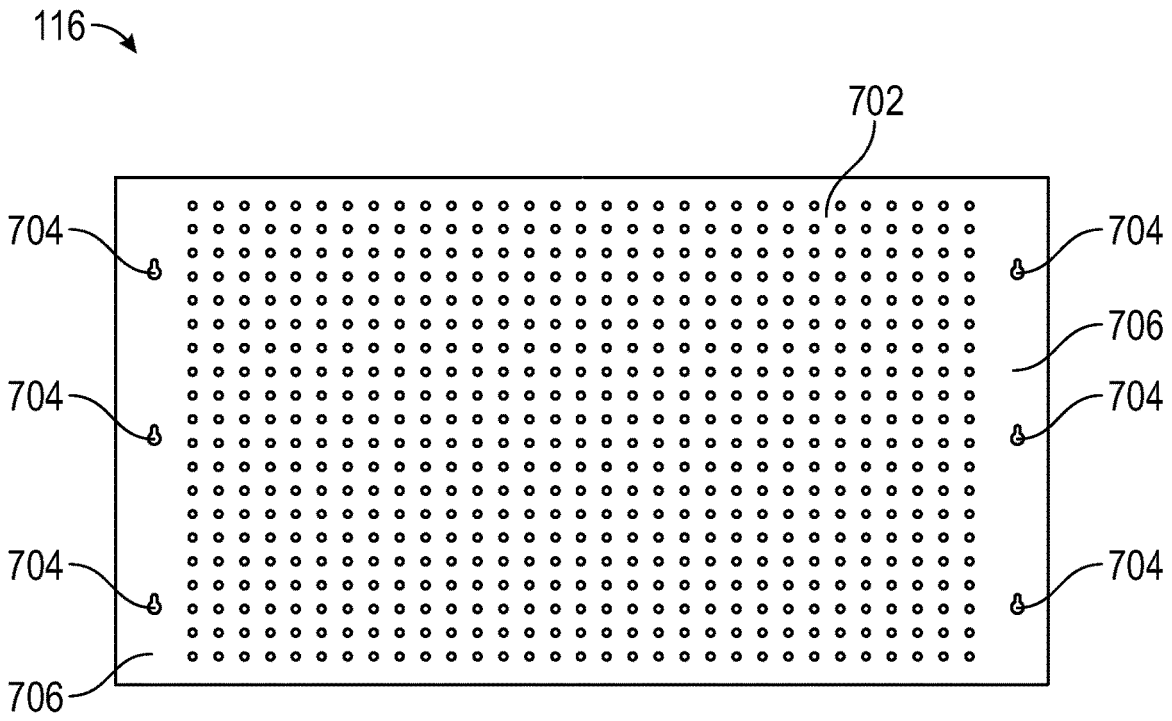
FIG. 7A illustrates a front view of a shelf of the storage system in a vertical position, according to some embodiments.

FIG. 7A illustrates a front view of shelf 116 of storage system 100 in a vertical position, according to some embodiments. In an exemplary configuration shown in FIG. 7A, shelf 116 may form a planar surface 702, and may preferably be comprised of a perforated surface, such as a pegboard configured to receive pins or holders for various tools. Shelf 116 may have a plurality of keyholes 704 in the side edges 706 of the planar surface 702, each keyhole 704 configured to receive a fastener, such as a single low-profile shoulder bolt or other appropriate fastener known to those skilled in the art, to attach the planar surface 702 at its side edges 706 to adjacent shelf supports 118.

Figure 7B:
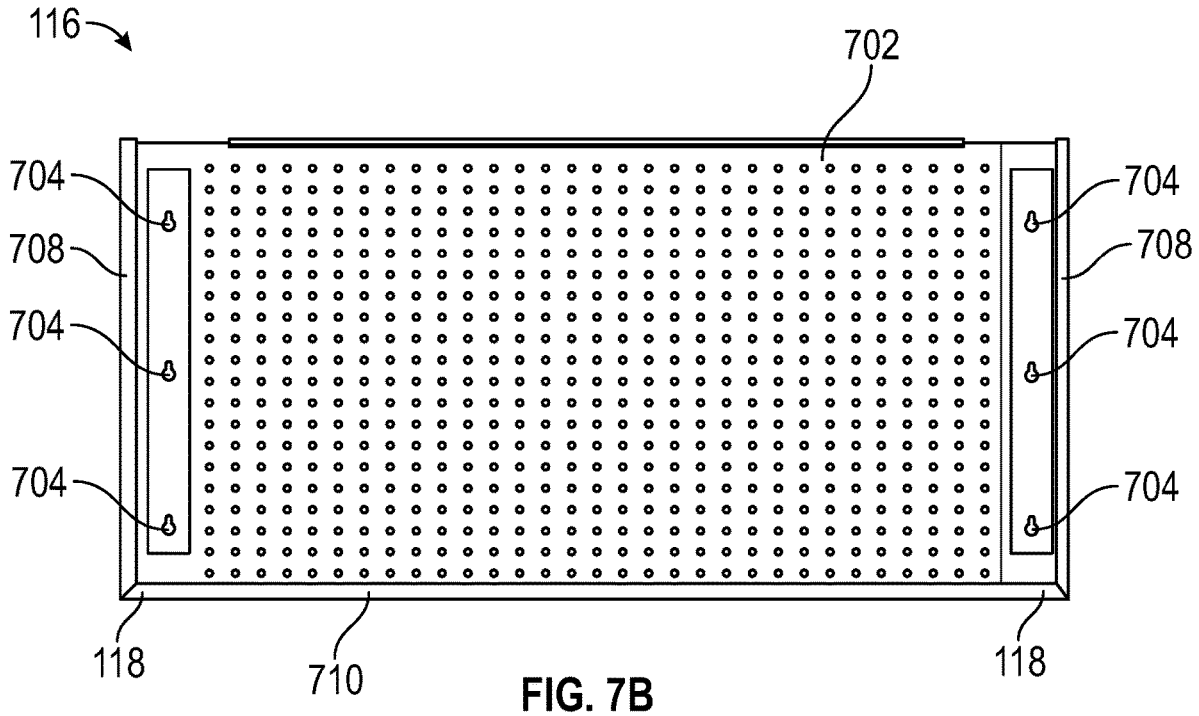
FIG. 7B illustrates a rear view of a shelf of the storage system in a vertical position, according to some embodiments.

FIG. 7B illustrates a rear view of shelf 116 of storage system 100 in a vertical position, according to some embodiments. As shown in FIG. 7B, each shelf 116 has rearwardly extending side edge walls 708 and a front edge wall 710, such that the planar surface 702 of shelf 116 is set away from the opposite edges of the side edge walls 708 and the front edge wall 710, thus defining an open space on the interior portion of each shelf 116 shaped to receive the extending arm of a shelf support 118. Preferably, each shelf support 118 (discussed in greater detail below) has an equal number of connection points (discussed below for FIG. 8A) that can be aligned with the keyholes 704 of shelf 116, each keyhole configured to receive a fastener, such as a single low-profile shoulder bolt, as discussed above for FIG. 7A, to attach the planar surface 702 at its side edges 706 to adjacent shelf supports 118 at the connection points. Such configuration allows easy, quick connection of a shelf 116 to a pair of adjacent shelf supports 118 by way of a quick drop and slide installation to temporarily lock the shelf 116 to the respective shelf supports 118.

Figure 8:
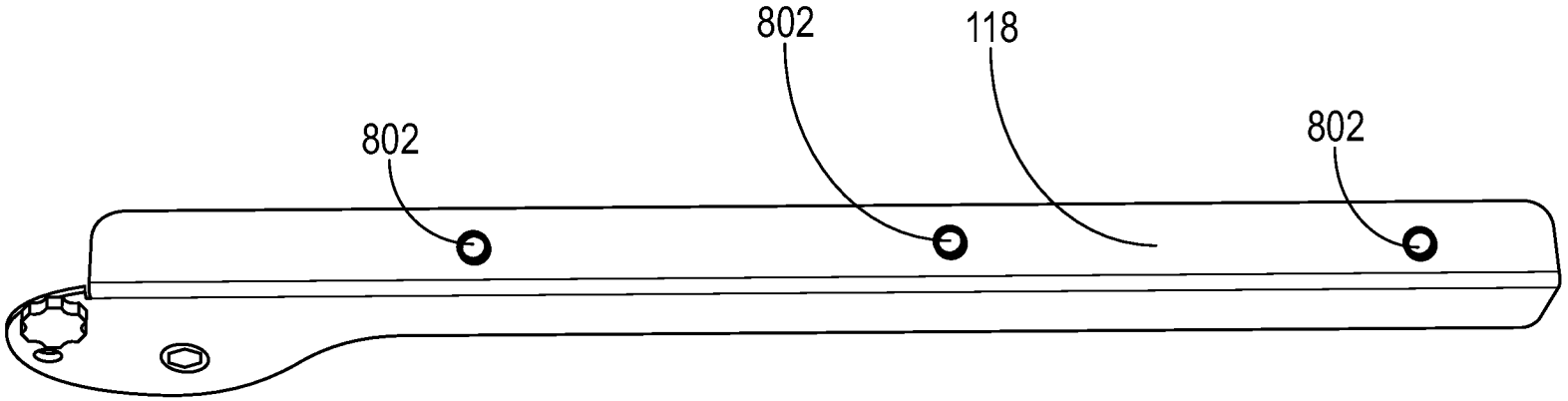
FIG. 8 illustrates a top view of a shelf support of the storage system, according to some embodiments.
Figure 9A:
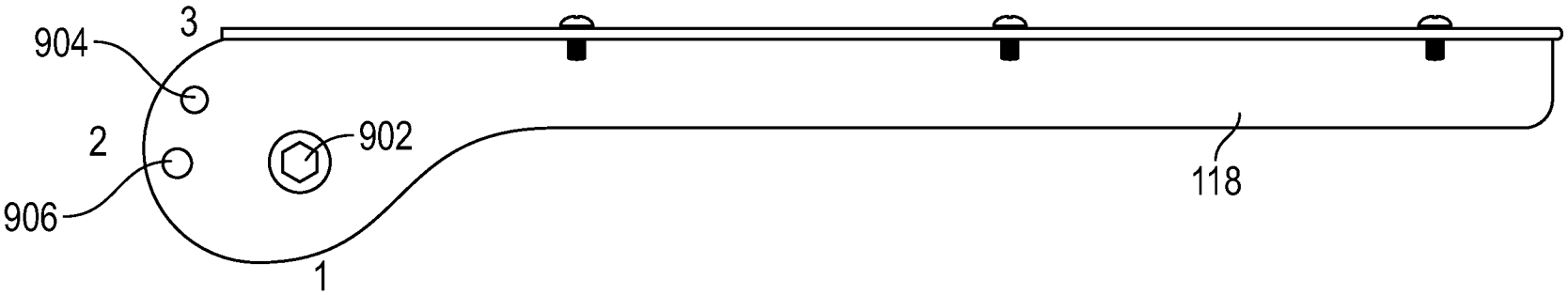
FIG. 9A illustrates a side view of the shelf support shown in FIG. 8, according to some embodiments.
Figure 9B:
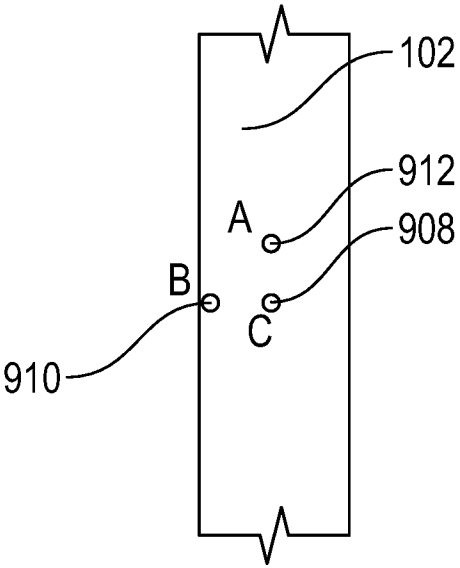
FIG. 9B illustrates aspects of the uprights of the storage system that enable pivotable integration of each shelf support with the uprights, according to some embodiments.

FIGS. 8, 9A, and 9B show various detail views of shelf support 118 and its connection to shelves 116 and uprights 102 to enable variable positioning of shelf supports 118 and shelves 116 to meet the various needs of the user.

FIG. 8 illustrates a top view of shelf support 118 of storage system 100, according to some embodiments. As shown in FIG. 8, each shelf support 118 has a plurality of connection points 802 to receive a fastener, such as a single low-profile shoulder bolt, as discussed above for FIGS. 7A and 7B, for connecting a shelf 116 to shelf supports 118. The hollow insert configuration of the back underside of each shelf 116 allows for the fastener to engage each shelf 116 through a quick connection assembly step.

Figure 11:
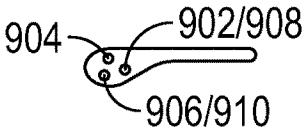
FIG. 11 provides a table that summarizes the association of the connection points of the shelf support to the connection points of the upright in each of the orientations, according to some embodiments.
Figure 11:
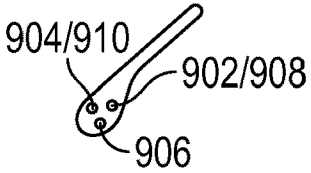
Figure 11:
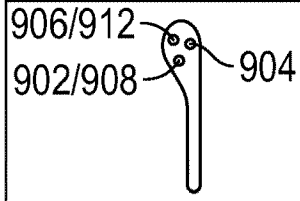

FIG. 9A illustrates a side view of the shelf support 118 shown in FIG. 8, according to some embodiments. FIG. 9B illustrates aspects of upright 102 of storage system 100 that enable pivotable integration of shelf support 118 with upright 102, according to some embodiments. As shown in FIG. 9A, a fixed-position pivot point 902 provides an opening for pivotably attaching each shelf support 118 to an upright 102 at upright pivot point 908 and allows shelf support 118 to swing into one of three pre-set positions around upright pivot point 908. The pre-set positions associate points #1 (fixed-position pivot point 902), #2 (lower hole 906), and #3 (upper hole 904) on shelf support 118 of FIG. 9A with points A (top opening 912), B (rear opening 910), and C (upright pivot point 908) on upright 102 of FIG. 9B, in various combinations, as the shelf support 118 pivots at fixed-position pivot point 902 on the upright 102 around upright pivot point 908. The combinations are illustrated in FIG. 11.

Figure 10A:
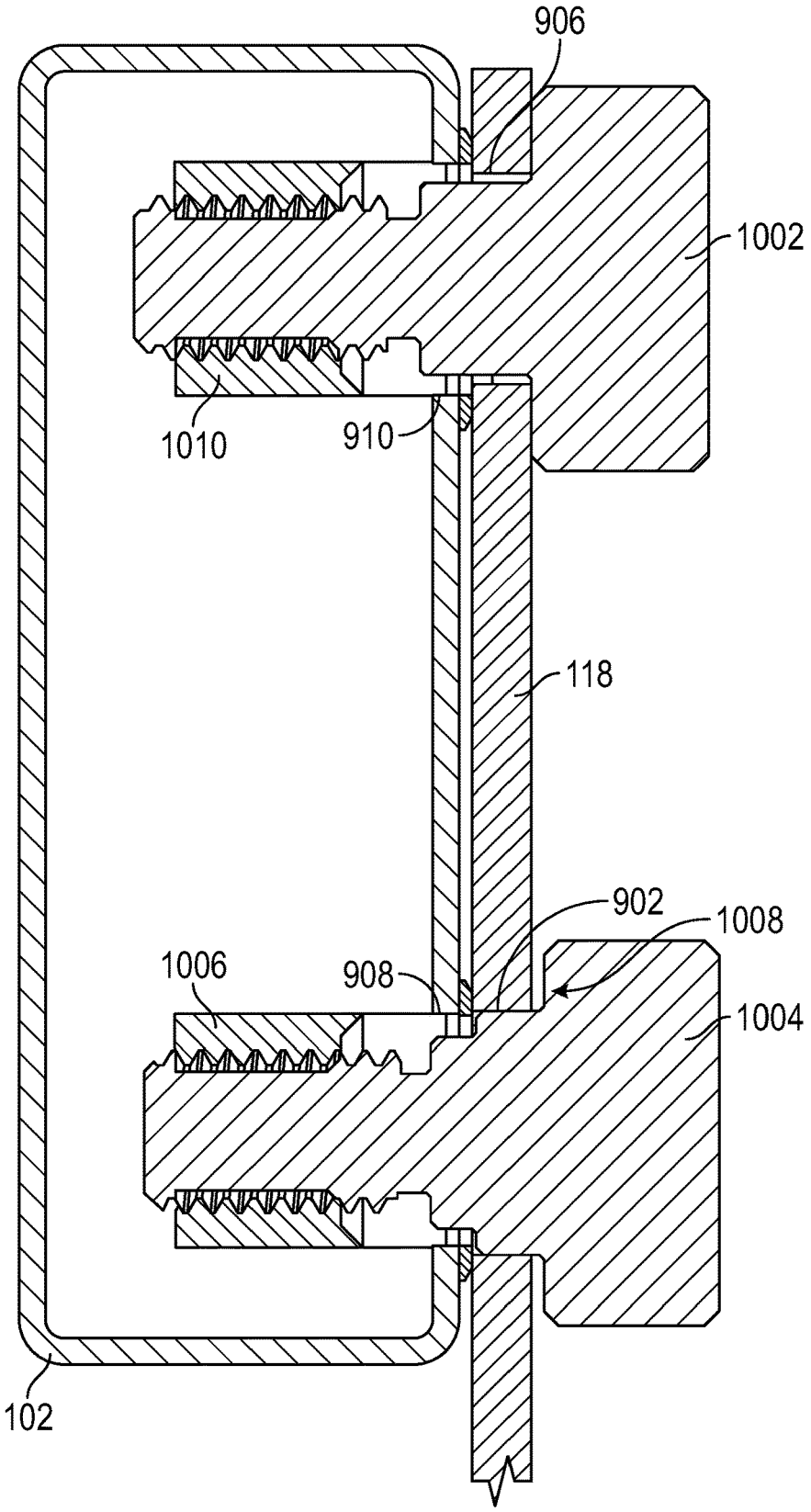
FIG. 10A illustrates a top cross-sectional view of a shelf support pivotably attached to a vertical upright, according to some embodiments.
Figure 10B:
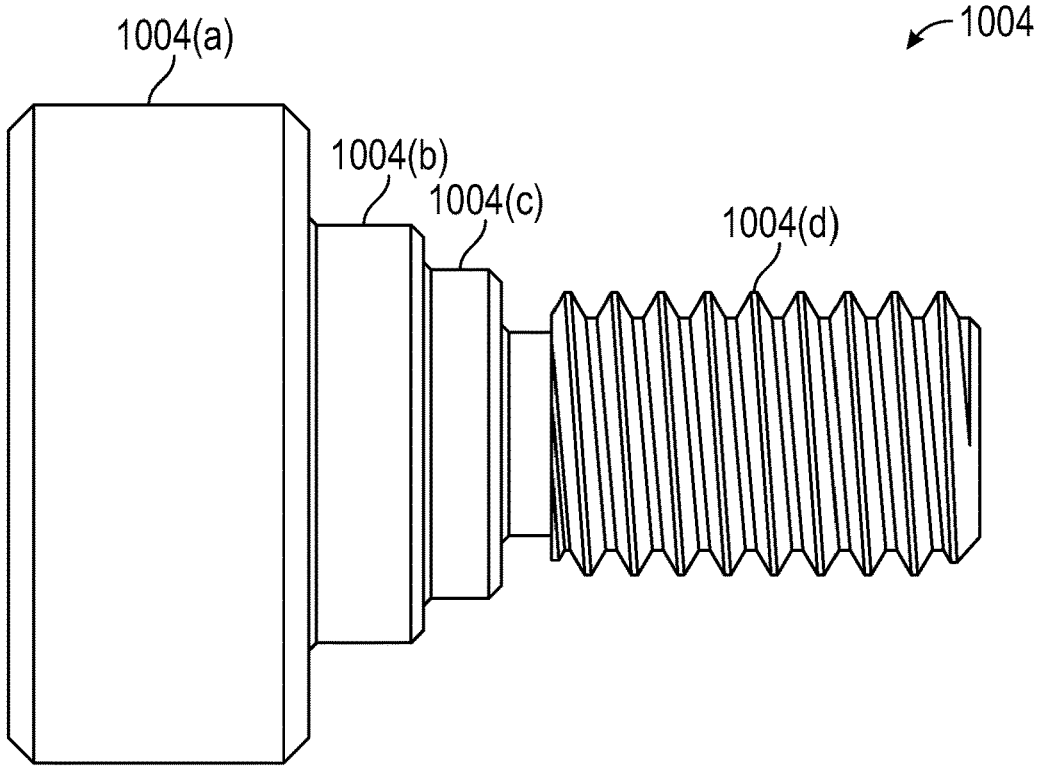
FIG. 10B provides detail of the attachment hardware illustrated in FIG. 10A, according to some embodiments.

FIGS. 10A-10D illustrate aspects of an exemplary configuration of shelf support 118 pivotably attached to upright 102 that enables easy pivoting movement of the shelf support 118 when desired, but nonetheless securely holds shelf support 118 in place against upright 102, according to some embodiments. FIG. 10A is a top cross-sectional view of shelf support 118 pivotably attached to upright 102, according to some embodiments. FIG. 10B provides detail of the attachment hardware illustrated in FIG. 10A, according to some embodiments. As shown in FIG. 10A, at fixed-position pivot point 902, fixed-position pivot pin 1004 (shown in detail in FIG. 10B) is provided having a head 1004(*a*), a dual-step shaft defining a first, larger diameter ring 1004(*b*) and a second, smaller diameter ring 1004(*c*), and a threaded shaft 1004(*d*) extending outward from smaller diameter ring 1004(*c*), which threaded shaft 1004(*d*) is configured to engage a mating threaded member 1006 on an interior of upright 102. Threaded member 1006 in some embodiments may comprise a rivet nut or "rivnut" of traditional configuration, formed as a one-piece internally threaded tubular rivet that is inserted through the opening in upright 102 that forms upright pivot point 908, with the head of the rivet nut on the exterior of upright 102 (and sitting between shelf support 118 and the outer wall of upright 102), and the internally threaded tubular portion extending into the interior of upright 102. Larger diameter ring 1004(*b*) extends through the opening of fixed-position pivot point 902 in shelf support 118, while smaller diameter ring 1004(*c*) extends through the opening in upright 102 that forms upright pivot point 908. Head 1004(*a*) of fixed-position pivot pin 1004 is formed such that when it is fully inserted into upright 102 and joined to threaded member 1006, a clearance 1008 exists between the interior face of head 1004(*a*) and the outer edge of shelf support 118 to ensure ease of pivoting movement of shelf support 118.

Positioning of threaded member 1006 on the interior of upright 102 renders it quite difficult to manually remove fixed-position pivot pin 1004 from the storage system without the aid of a tool. Moreover, the dual-stepped configuration of fixed-position pivot pin 1004 allows torque to be directed to the outer surface of threaded member 1006 from larger diameter ring 1004(*b*) without binding to the shelf support 118, while insertion of smaller diameter ring 1004(*c*) (inserted into the cavity of the threaded member 1006) provides a reinforcement layer that prevents structural deformation of the wall of the threaded member 1006 when large loads are placed on shelves attached to shelf support 118.

Figure 10C:
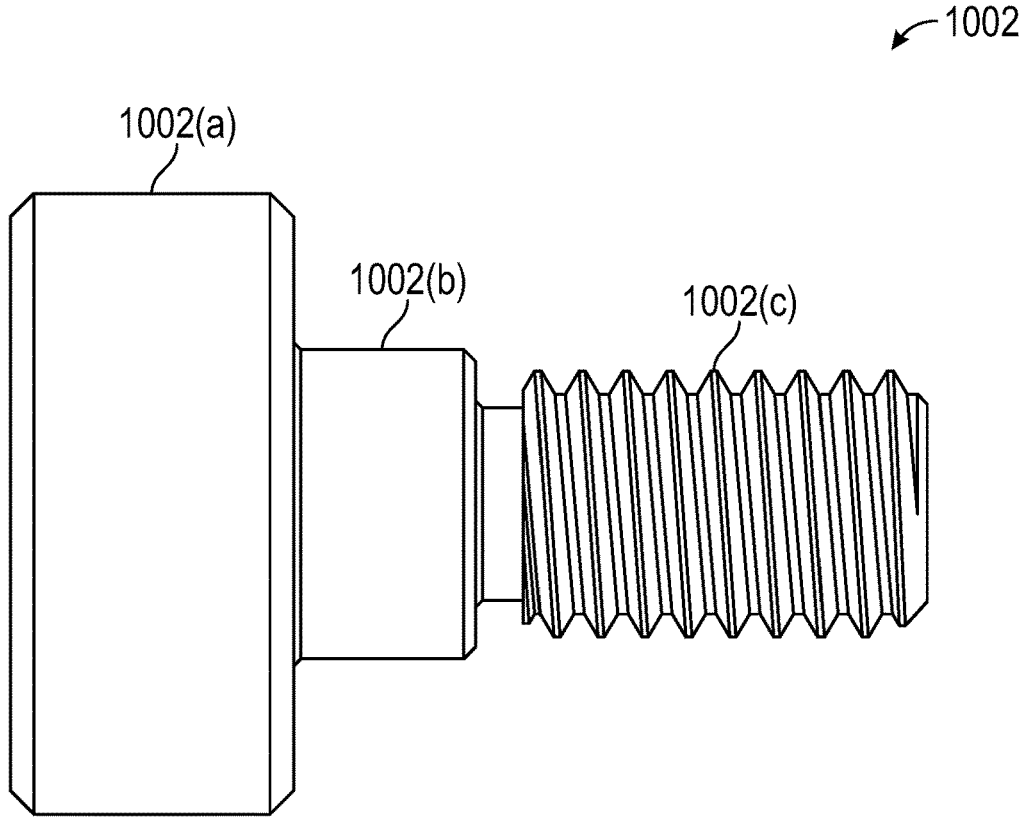
FIG. 10C provides detail of shelf adjustment hardware, according to some embodiments.

FIG. 10C provides detail of shelf adjustment hardware, according to some embodiments. To selectively lock the position of shelf support 118 in a desired position, each of rear opening 910 and top opening 912 in upright 102 (e.g., rear opening 910 shown in the cross-sectional view of FIG. 10A) are likewise provided a threaded member 1010 similar in configuration to threaded member 1006. Each threaded member 1010 is configured to receive shelf adjustment pin 1002 (shown in detail in FIG. 10C) therein to selectively lock shelf support 118 in a desired position. More particularly, shelf adjustment pin 1002 includes a head 1002(*a*), a single ring 1002(*b*) extending outward from head 1002(*a*), and a threaded shaft 1002(*c*) extending outward from the single ring 1002(*b*), which threaded shaft 1002(*c*) is configured to engage mating threaded member 1010 on the interior of upright 102. Single ring 1002(*b*) extends through one of the selected openings, upper hole 904 and lower hole 906 in shelf support 118 (e.g., lower hole 906 shown in the cross-sectional view of FIG. 10A), with the threaded shaft 1002(*c*) joining to threaded member 1010 to press head 1002(*a*) flush against the outer surface of shelf support 118 to firmly clamp shelf support 118 in the desired position. As with fixed-position pivot pin 1004, the single ring 1002(*b*) of shelf adjustment pin 1002 provides a reinforcement layer that prevents deformation of the wall of threaded member 1010 when large loads are placed on shelves attached to shelf support 118.

Figure 10D:
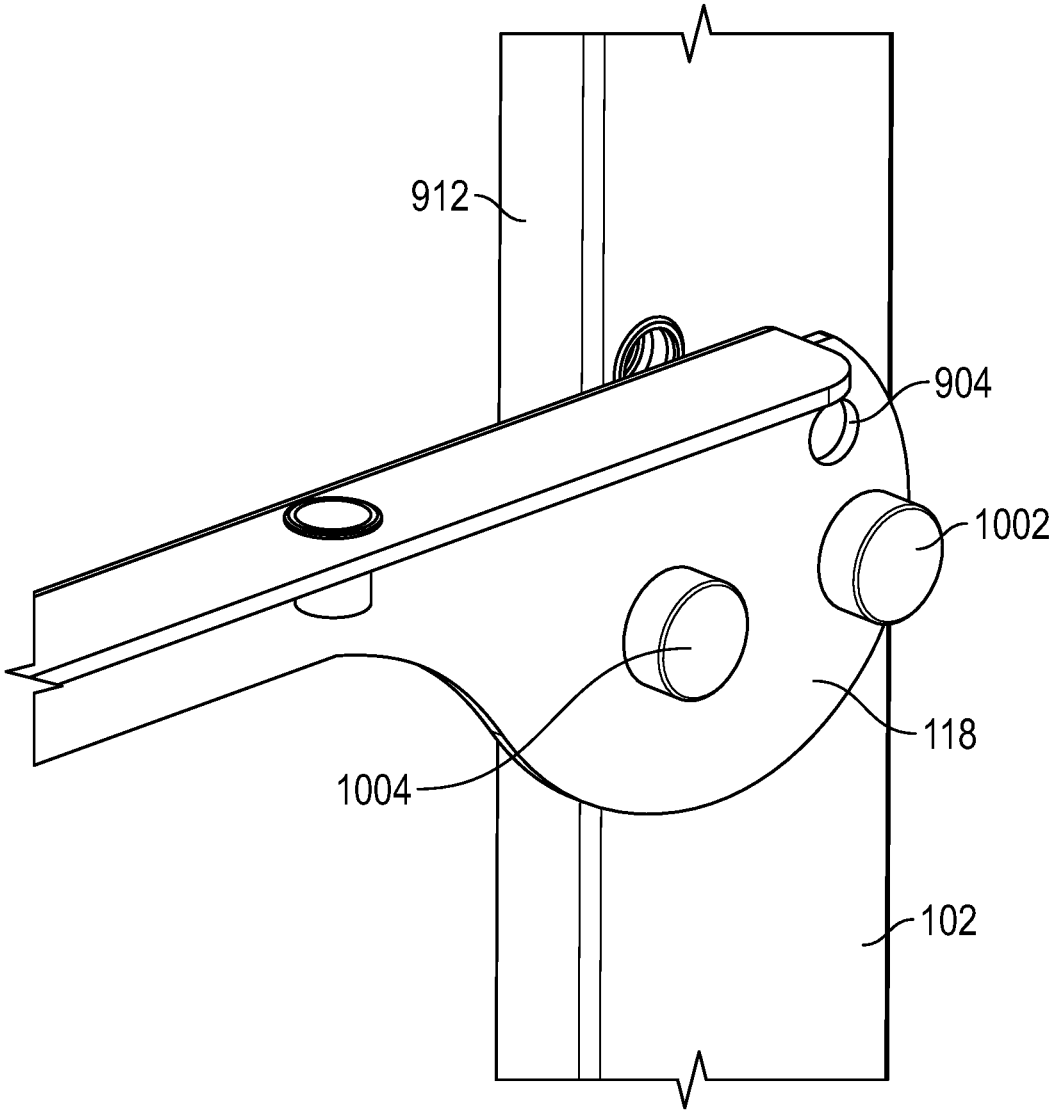
FIG. 10D illustrates a shelf support joined to a vertical upright with a fixed-position pivot pin pivotably attaching the shelf support to the upright, according to some embodiments.

FIG. 10D illustrates shelf support 118 joined to an upright 102 with fixed position pivot pin 1004 pivotably attaching shelf support 118 to upright 102, according to some embodiments. In this example shelf adjustment pin 1002 temporarily locks the position of shelf support 118 so that it maintains a horizontal orientation.

Thus, in one orientation, shelf support 118 may pivot about fixed-position pivot point 902 to an upward orientation (as shown, for example, in section 100-B of FIG. 1), in which upper hole 904 on shelf support 118 (point #3 in FIG. 9A) may align with rear opening 910 (point B in FIG. 9B) on upright 102, and may be locked in position with shelf adjustment pin 1002 as described above. In this configuration, and without shelf 116 placed on shelf support 118, the upwardly angled shelf support 118 may be used to hold, for example, sections of PVC pipe, light metal conduit, or such other items as will occur to those skilled in the art. In such elevated position, shelf 116 may likewise be used (itself similarly assuming an elevated position) to meet various needs of the user.

Additionally, shelf support 118 may pivot about fixed-position pivot point 902 to a horizontal orientation (as shown in section 100-A of FIG. 1), in which lower hole 906 on shelf support 118 (point #2 in FIG. 9A) may align with rear opening 910 (point B in FIG. 9B) on upright 102, and may be locked in position with shelf adjustment pin 1002 inserted through each of lower hole 906 on shelf support 118 and rear opening 910 on upright 102 to hold shelf support 118 in the horizontal position of section 100-A of FIG. 1.

Still further, shelf support 118 may pivot about fixed-position pivot point 902 to a vertical orientation (as shown in section 100-C of FIG. 1), in which lower hole 906 on shelf support 118 (point #2 in FIG. 9A) may align with top opening 912 (point C in FIG. 9B) on upright 102, and may be locked in position with shelf adjustment pin 1002 inserted through each of lower hole 906 on shelf support 118 and top opening 912 on upright 102 to hold shelf support 118 in the vertical position of section 100-C of FIG. 1. Notably, in this vertical orientation, upper hole 904 on shelf support 118 may not be in use or engaged with upright 102.

In the above orientations, it is noted that the positioning of upper hole 904 and lower hole 906, with respect to fixed-position pivot point 902 on shelf support 118, are different from the positioning of rear opening 910 and top opening 912 with respect to upright pivot point 908 on upright 102. FIG. 11 provides a table that summarizes the association of the connection points of shelf support 118 to the connection points of upright 102 in each of the orientations, according to some embodiments.

Figure 12A:
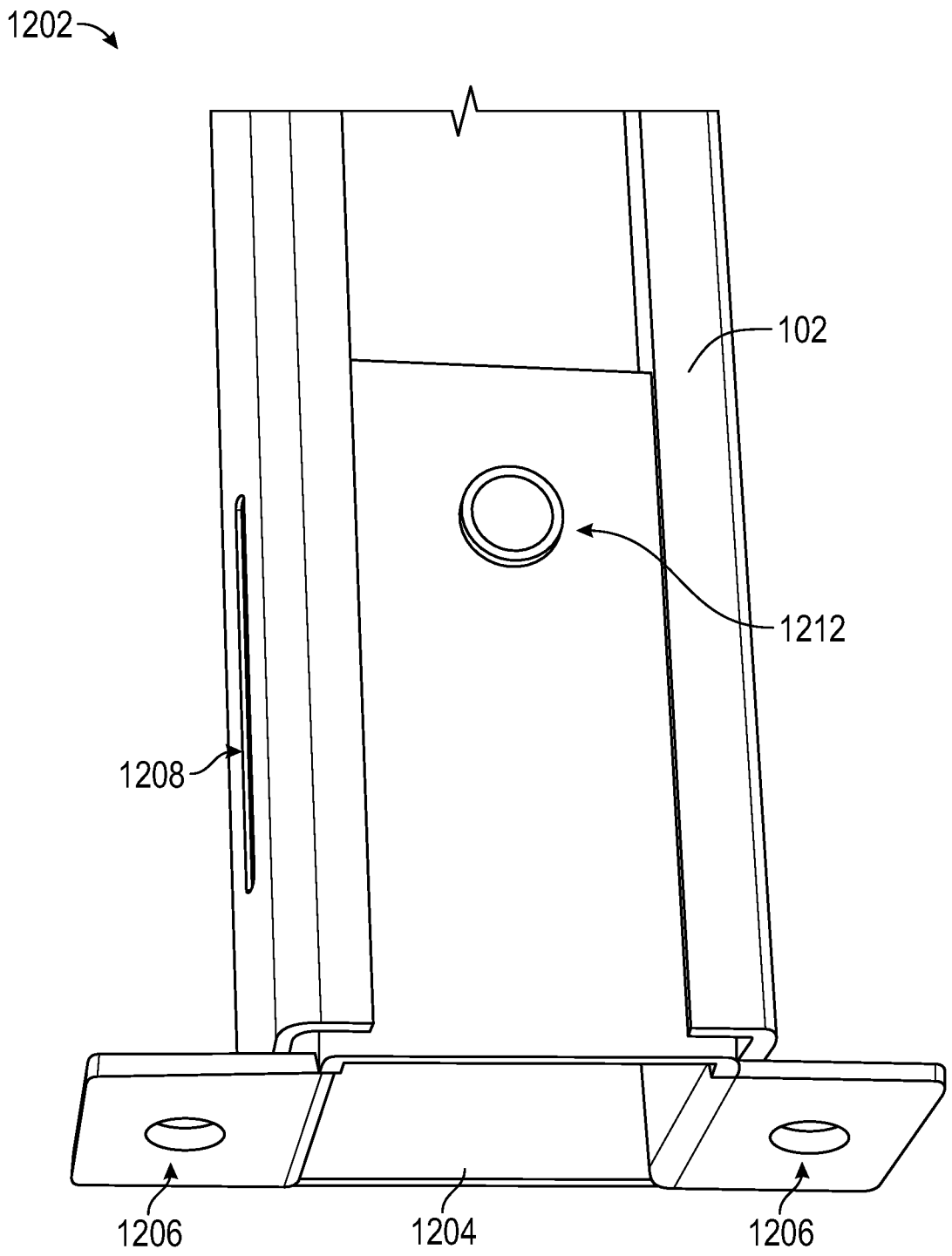
FIG. 12A illustrates an optional footer inserted into the bottom of an upright of the storage system, according to some embodiments.
Figure 12B:
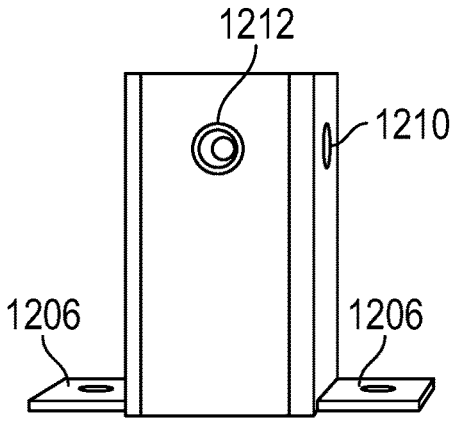
FIG. 12B illustrates a front view of the footer, according to some embodiments.
Figure 12C:
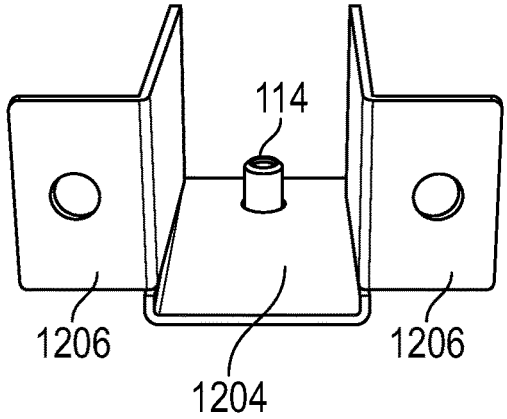
FIG. 12C illustrates a bottom view of the footer, according to some embodiments.
Figure 12D:
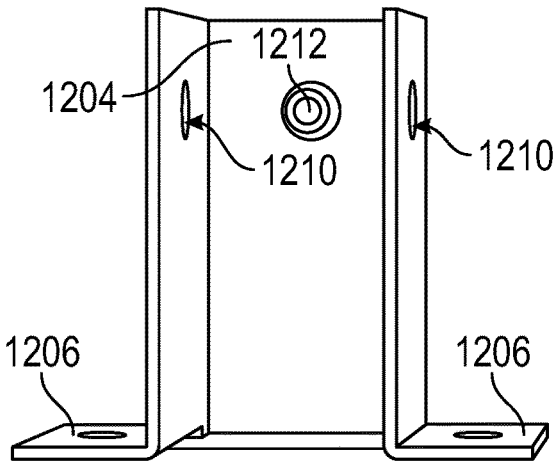
FIG. 12D illustrates a back view of the footer, according to some embodiments.
Figure 12E:
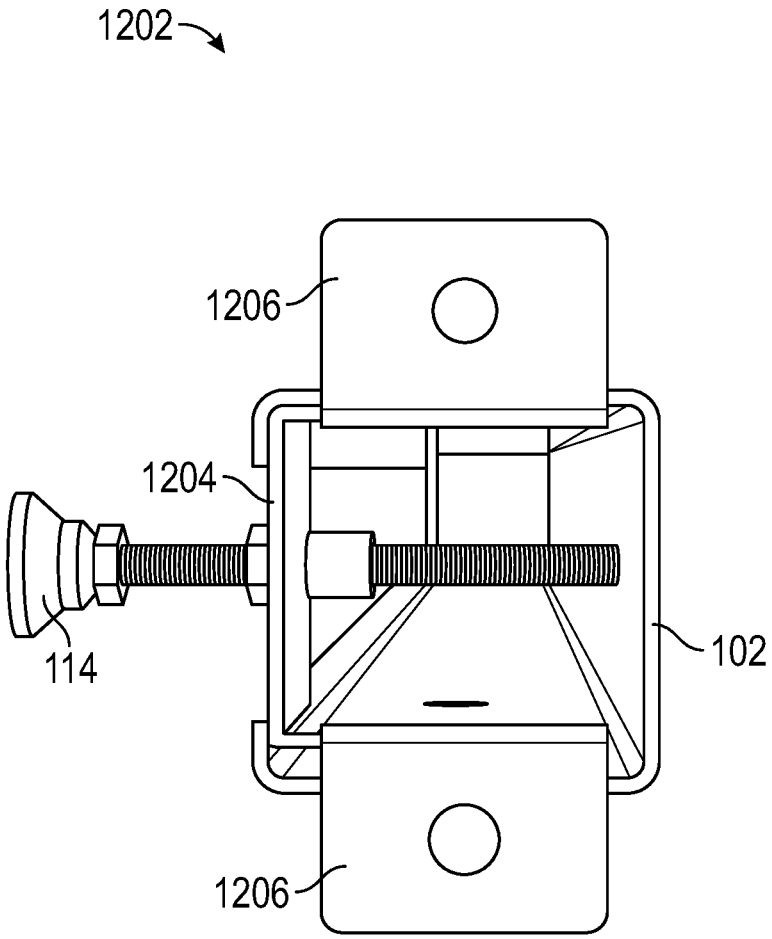
FIG. 12E illustrates a bottom view of a footer assembly installed in an upright of the storage system, according to some embodiments.

FIGS. 12A-12E provide details of an optional footer assembly 1202 for the uprights 102 of the storage system 100, according to some embodiments. FIG. 12A illustrates a footer 1204 that may be inserted into the bottom of an upright 102 of storage system 100, according to some embodiments. FIG. 12B illustrates a front view of footer 1204, according to some embodiments. FIG. 12C illustrates a bottom view of footer 1204, according to some embodiments. FIG. 12D illustrates a back view of footer 1204, according to some embodiments. FIG. 12E illustrates a bottom view of footer assembly 1202 installed in upright 102 of storage system 100, according to some embodiments.

As shown in FIG. 12A, each footer 1204 has floor anchors 1206 extending outward from the bottom of each footer 1204, allowing connection of the footer 1204 to the floor of the container via bolts, screws, or similarly configured connectors, and providing floor stabilization of the storage system 100 when mounted within the container.

Further, as shown in FIG. 12A, each upright 102 includes an elongated hole 1208 at the bottom sidewall of the upright 102 which aligns with an opening 1210 in footer 1204, as shown in FIG. 12B, through which a bolt or similar fastener may be inserted to hold footer 1204 to upright 102 while allowing footer 1204 to slide up and down within the bottom portion of upright 102 to provide for vertical leveling of the upright 102. Each footer 1204 also has a threaded opening 1212 configured to receive an optional swivel leveling mount 114, as shown in FIGS. 1 and 12C. Swivel leveling mount 114 can be used to brace the footer 1204 installed in the upright 102 on a horizontal axis against the container wall and at an adjustable distance from the container wall.

FIGS. 6 and 12E further illustrate the installation of the swivel leveling mount 114 into the footer 1204 of the storage system 100, according to some embodiments. As shown in FIG. 6, if swivel leveling mounts 114 are installed, the storage system 100 may preferably have one independently adjustable swivel leveling mount 114 per upright 102.

Storage system 100 is particularly adaptable for installation and use in a space such as a shipping or transportable storage container. In such an installation, storage system 100 includes various hardware for securing storage system 100 inside a container. Storage system 100 may be installed inside a container by such methods as hanging the system from the container wall, fastening the system to the container floor, or a combination of these methods as would be understood by a person having ordinary skill in the relevant art. In certain configurations, storage system 100 need not include footers 1204 and uprights 102 may terminate at their bottom ends a distance above the floor of the container in which storage system 100 is installed.

Figure 13:
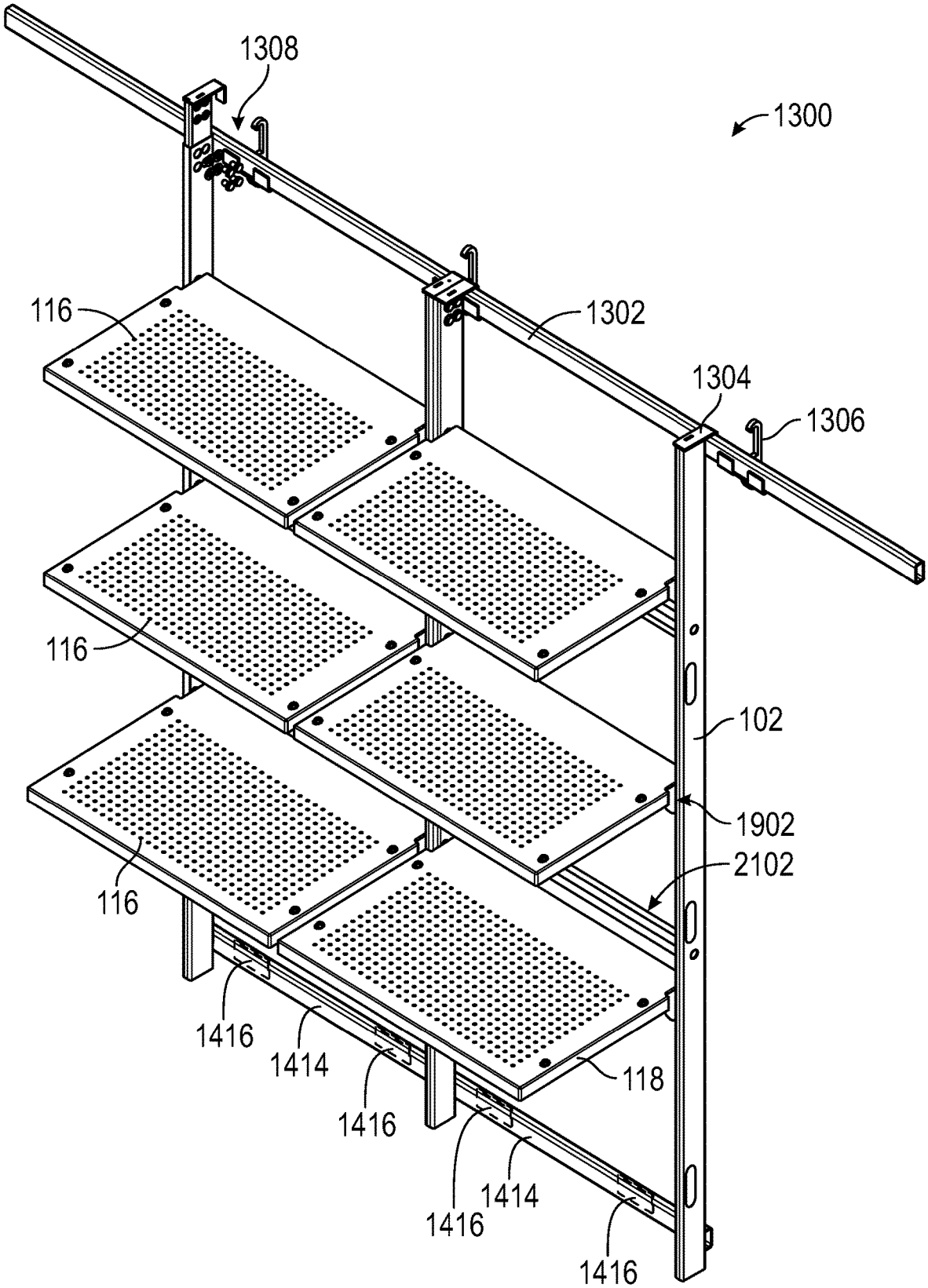
FIG. 13 illustrates an example of a hardware configuration for suspension of the storage system from a wall of a shipping container, according to some embodiments.

FIG. 13 illustrates an example of a hardware configuration 1300 for suspension of storage system 100 from a container wall, according to some embodiments. As illustrated in FIG. 13, storage system 100 is preferably suspended from a support bar 1302 at a height to ensure that the bottom-most shelves 116, when folded downward into a vertical position, do not contact the floor of the container in which storage system 100 is installed. Likewise, uprights 102 preferably have a length dimension such that a bottom portion of each upright 102 extends downward past a bottom edge of the bottom-most shelf 116 when such bottom-most shelf is positioned vertically downward. This ensures that during storage, uprights 102 will rest on the ground even when shelves 116 and shelf supports 118 are oriented vertically downward. Each of the uprights 102 of storage system 100 may be suspended from the support bar 1302 by a tube hanger 1304, 1308 as further detailed below and shown in FIGS. 16A and 16B. The support bar 1302 may be suspended from the container wall by a hanger hook 1306, as further detailed below and shown in FIG. 15.

Figure 14A:
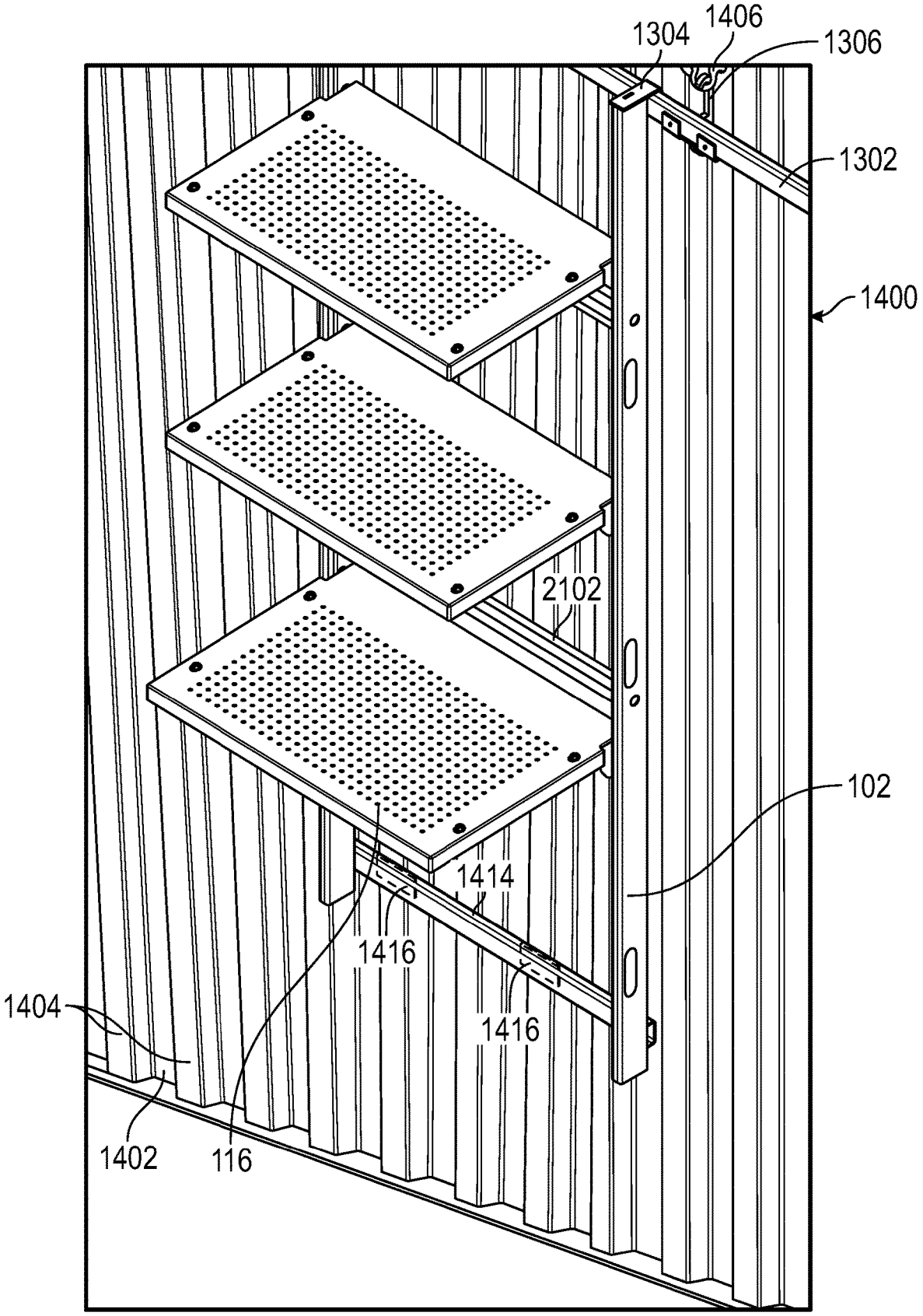
FIG. 14A illustrates the storage system suspended from a container wall, according to some embodiments.

FIGS. 14A-14E further illustrate examples of hardware for suspending storage system 100 in relationship to the wall 1400 of a shipping container, according to some embodiments. FIG. 14A illustrates storage system 100 suspended from a container wall 1400, according to some embodiments. As shown in FIG. 14A, shipping containers are typically formed having a metal corrugated wall 1400, in which vertical channels 1402 are defined between vertical outer faces 1404 of wall 1400. Support bar 1302 can be suspended from the container wall by a hanger hook 1306 using conventional built-in features of the container wall 1400.

Figure 14B:
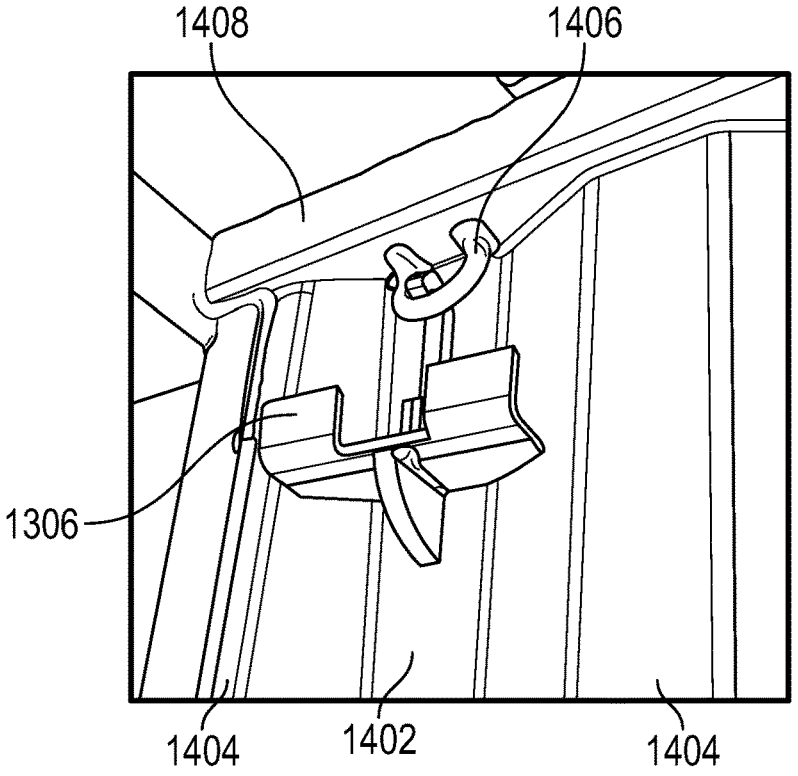
FIG. 14B illustrates an example of a rigid loop of a container wall used for hanging of a hanger hook, according to some embodiments.
Figure 14C:
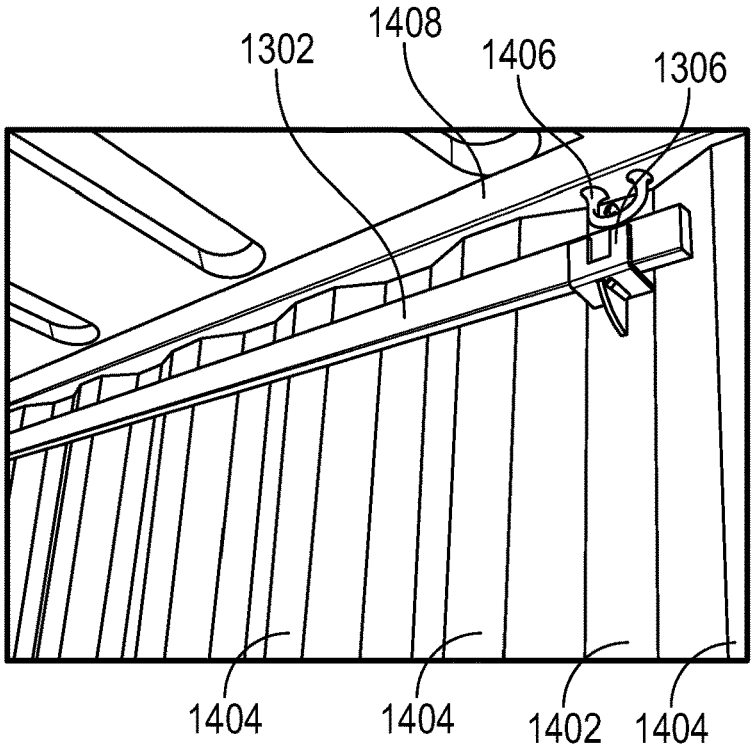
FIG. 14C illustrates an example of a support bar suspended from multiple hanger hooks, according to some embodiments.

Particularly, FIG. 14B illustrates an example of a conventional rigid loop 1406 of a container wall 1400, which may suspend a hanger hook 1306, according to some embodiments. FIG. 14C illustrates an example of a support bar 1302 suspended from multiple hanger hooks 1306, according to some embodiments. FIG. 14A further illustrates an example of uprights 102 of storage system 100 suspended from support bar 1302, according to some embodiments. Generally, storage system 100 can be suspended from a plurality of rigid loops 1406 that are attached to an upper, horizontal beam 1408 along container wall 1400. Rigid loops 1406 are typically built into the container wall 1400 and located within and at the top of vertical channels 1402 at equidistant locations. Such rigid loops 1406 are typically permanently affixed at their locations within vertical channels 1402, such as by welding or other fixation methods known to those skilled in the art. However, between different shipping containers, such rigid loops 1406 can be located in vertical channels 1402 in different locations along the length of container wall 1400, rendering it challenging to use multiple such rigid loops 1406 for suspension of structures having a fixed configuration.

To address this challenge, as illustrated by the combination of FIGS. 14A-14C, the disclosed suspension system enables storage system 100 to be placed anywhere along the length of the container wall 1400, regardless of the particular location of rigid loops 1406 along the wall 1400. Such variable positioning of storage system 100 may be achieved by enabling its suspension from support bar 1302 held by hanger hooks 1306 that engage rigid loops 1406. In such configuration, the backside of each upright 102 may sit forward of (or optionally flush against) a vertical outer face 1404 of corrugated container wall 1400, such that the entirety of storage system 100 is positioned outside of all surfaces of container wall 1400 (including being outside of vertical channels 1402). See, for example, FIG. 14A. Storage system 100 thus may be placed at any desired lengthwise location along container wall 1400 without interference from container wall 1400.

Further, as shown in FIGS. 14B and 14C, hanger hooks 1306 may be suspended from any two or more rigid loops 1406 along the length of container wall 1400, regardless of the location of rigid loops 1406, while suspending support bar 1302. Support bar 1302 may hang from hanger hooks 1306 at variable locations along support bar 1302. Likewise, as shown in FIG. 14A, uprights 102 of the storage system 100 may be suspended from support bar 1302 by tube hangers 1304 anywhere along the length of support bar 1302, regardless of the location of rigid loops 1406.

Figure 14D:
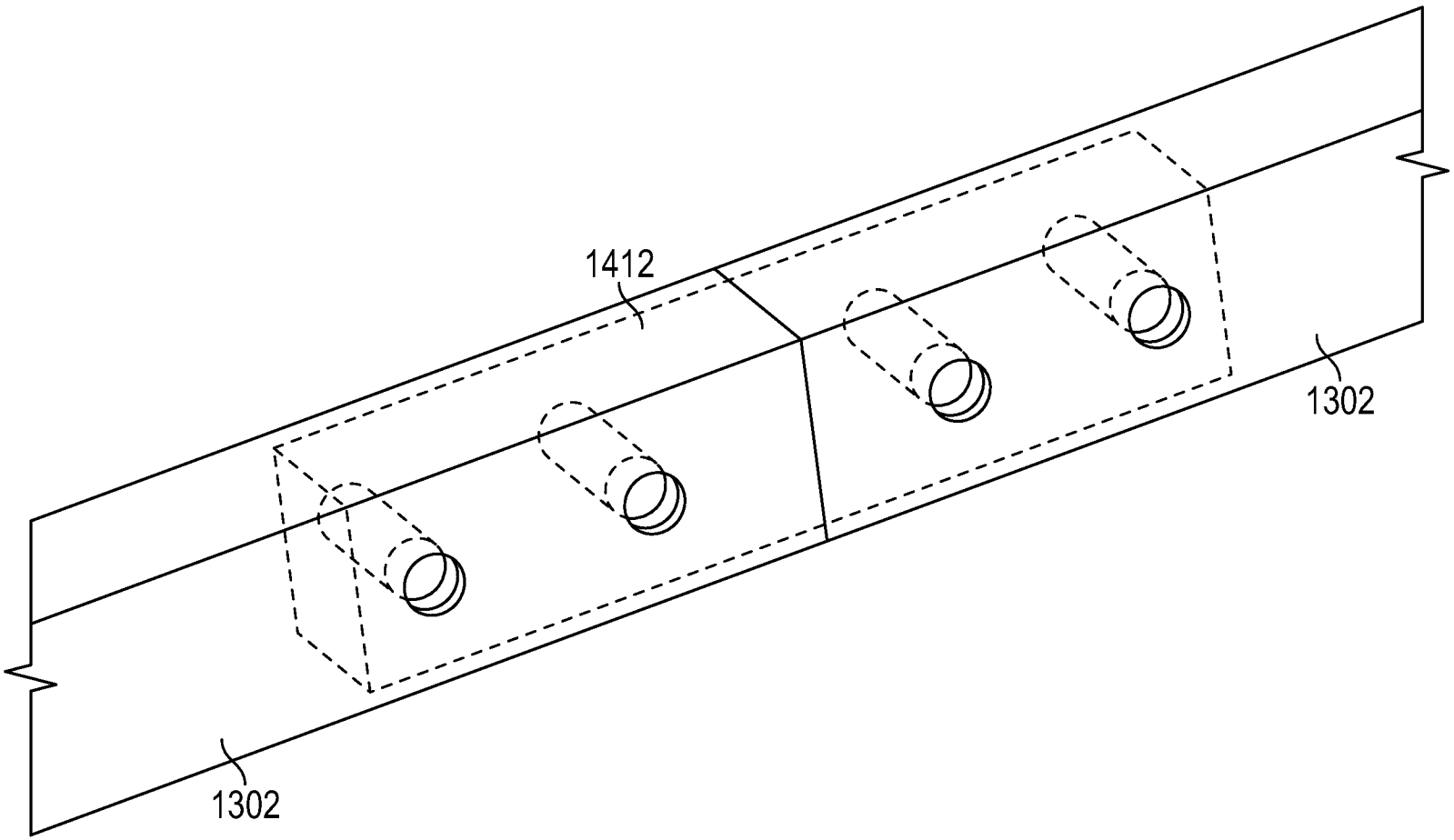
FIG. 14D illustrates hardware for connecting multiple support bars to expand storage and system, according to some embodiments.

FIG. 14D illustrates hardware for connecting multiple support bars 1302 to expand storage system 100, according to some embodiments. As shown in FIG. 14D, multiple support bars 1302 may be placed adjacent to one another and joined, by way of non-limiting example, by inserting an internal sleeve 1412 into adjoining support bars 1302. For example, internal sleeve 1412 may be inserted into adjacent ends of a pair of support bars 1302 and held in place with screws or similarly configured fasteners passing through the front of adjacent ends of two support bars 1302 and into internal sleeve 1412 to maintain the adjoining support bars 1302 in fixed alignment with one another. Thus, storage system 100 may ultimately be suspended from rigid loops 1406 regardless of the points of fixation of rigid loops 1406 along container wall 1400.

Figure 15:
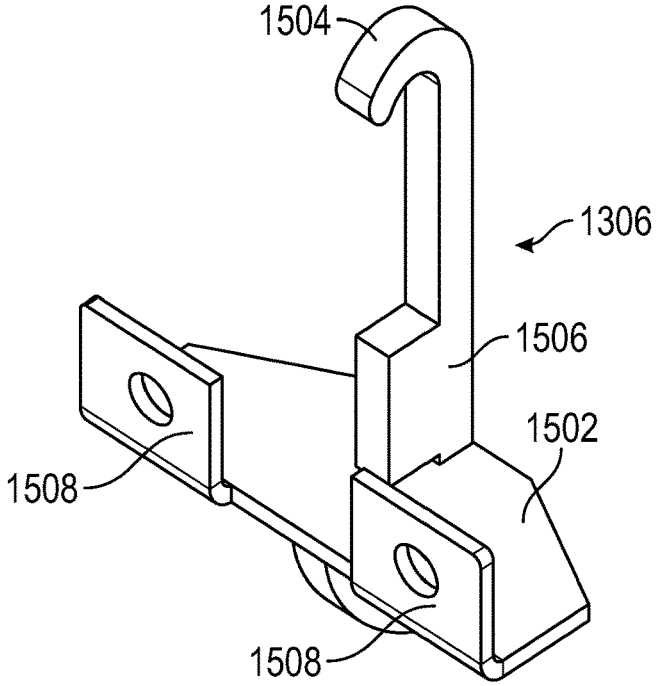
FIG. 15 illustrates a detailed perspective view of a hanger hook, according to some embodiments.
Figure 16A:
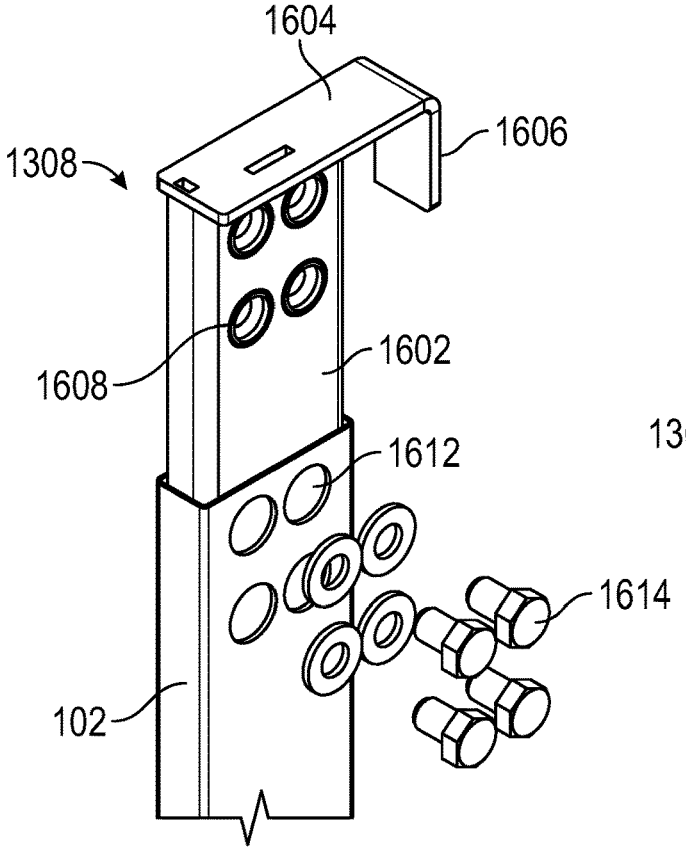
FIG. 16A illustrates a detailed perspective view of a tube hanger with an upright of the storage system, according to some embodiments.
Figure 16B:
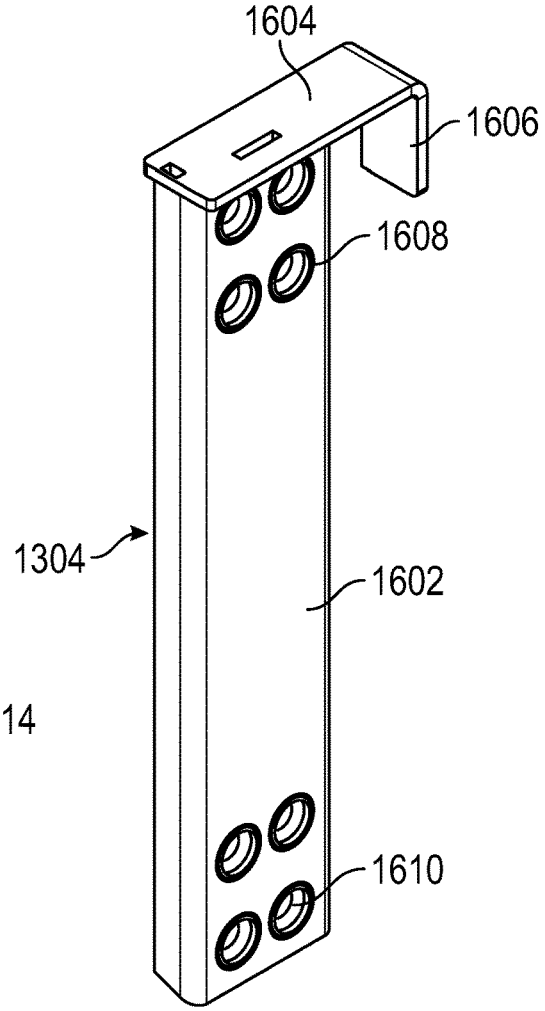
FIG. 16B illustrates the main body of the tube hanger, according to some embodiments.
Figure 16C:
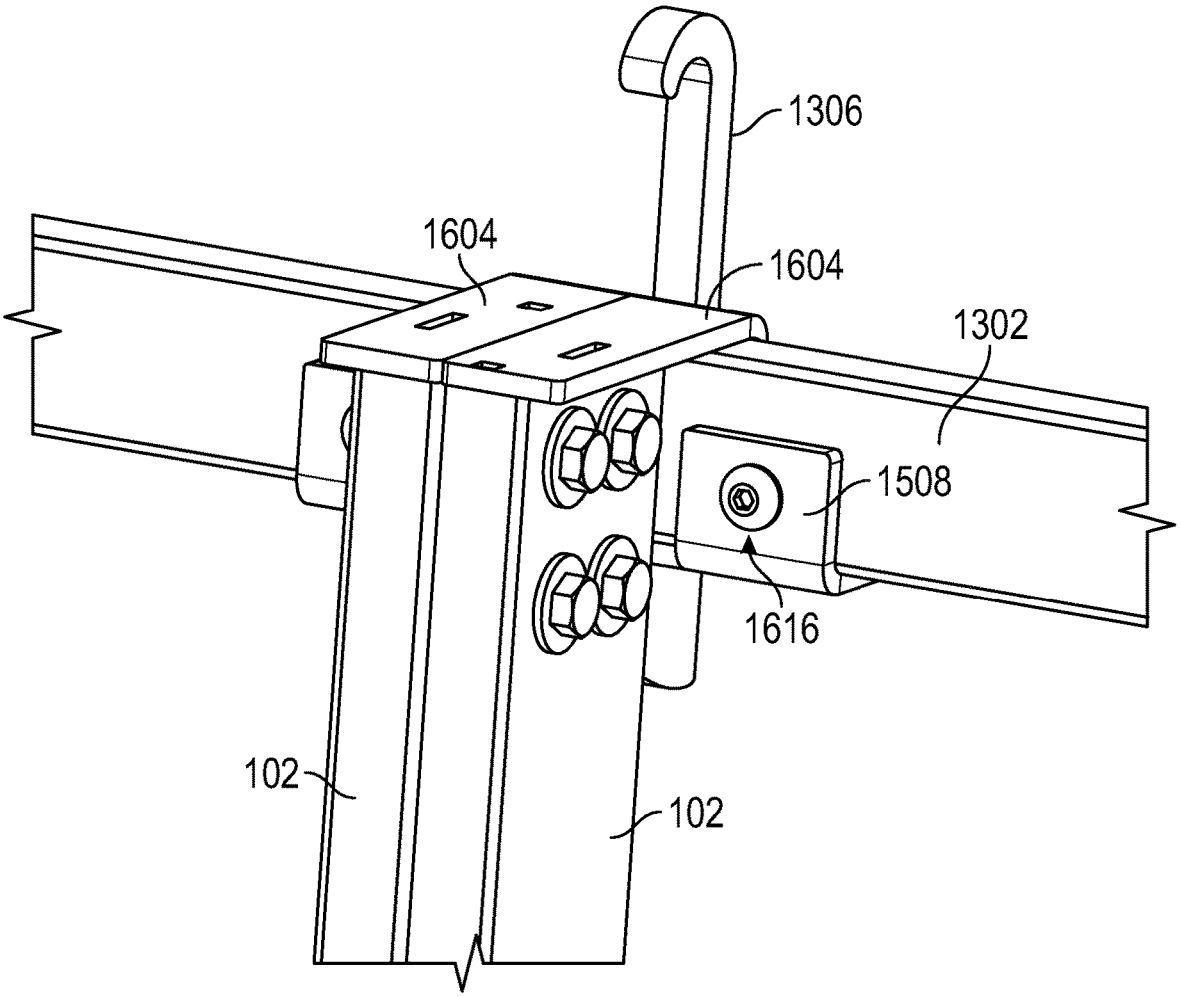
FIG. 16C illustrates a detailed view of two adjoined uprights hung by tube hangers from a support bar, which is supported by a hanger hook, according to some embodiments.

FIG. 15 illustrates a detailed perspective view of one configuration of a hanger hook 1306, according to some embodiments. Hanger hook 1306 includes a generally planar hook base 1502 that can receive a bottom side of support bar 1302, and a hook arm 1504 extending upward from the back side of planar hook base 1502, with a curved hook end configured to engage a rigid loop 1406 on container wall 1400. Particularly, hook arm 1504 is configured to engage rigid loop 1406 from behind rigid loop 1406 (i.e., between rigid loop 1406 and vertical channel 1402). The bottom of hook arm 1504 (immediately adjacent to planar hook base 1502) comprises a widened hook arm base 1506, such that the front side of hook arm base 1506 retains the back side of support bar 1302. Further, planar hook base 1502 also includes one or more retainer plates 1508 extending upward from the front side of planar hook base 1502 that retain the front side of support bar 1302. Retainer plates 1508 can each have a hole to receive an optional fastener as shown in FIG. 16C. As shown in FIGS. 14B-14D, support bar 1302, when held within hanger hooks 1306, is positioned forward of (or optionally flush against) the vertical outer face 1404 of corrugated container wall 1400.

As shown in FIGS. 13 and 14D, storage system 100 may be suspended from support bar 1302 with telescoping tube hangers 1304 that are extensible from a top end of uprights 102. FIG. 16A illustrates a detailed perspective view 1308 of tube hanger 1304 and its integration with an upright 102, according to some embodiments. FIG. 16B illustrates the main body 1602 of tube hanger 1304, according to some embodiments.

As shown in FIG. 16A, tube hangers 1304 include a main body 1602 configured to slide within upright 102, and a flat, generally low-profile (e.g., formed, by way of non-limiting example, of sheet metal) top plate 1604 extending toward and beyond a back wall of main body 1602. From the back edge of top plate 1604, a support bar hook 1606 extends downward from the top plate 1604 and is configured to engage a back side of support bar 1302. The portion of top plate 1604 between main body 1602 and support bar hook 1606 then rests on the top face of support bar 1302 to suspend the entire storage system 100 from the support bar 1302, allowing easy placement and longitudinal adjustment of each section of storage system 100 along the length of support bar 1302. Tube hangers 1304 may optionally engage support bar 1302 at the location of a hanger hook 1306, as a gap is present between the front face of hook arm 1504 and the back face of support bar 1302 (caused by the differing depth dimensions of hook arm 1504 and the larger hook arm base 1506) that may optionally receive support bar hook 1606 in alignment with hook arm 1504. This configuration also enables consistent placement of storage system 100 at a particularly desired matching location among multiple containers, even if the rigid loops 1406 of those containers are placed at differing locations among multiple containers.

As shown in FIG. 16B, tube hanger 1304 preferably includes at least a set of upper tube hanger connector receivers 1608 and a set of lower tube hanger connector receivers 1610, although additional sets of tube hanger connector receivers may likewise be provided to allow for greater vertical positioning options. As shown in combination with FIG. 16A, each of upper tube hanger connector receivers 1608 and lower tube hanger connector receivers 1610 are configured to align with a set of upright connector receivers 1612, whereby connectors 1614 (such as by way of non-limiting example fastening members such as screws, bolts, pins, or the like) may be inserted through upright connector receivers 1612 and into upper tube hanger connector receivers 1608 or lower tube hanger connector receivers 1610 to hold the position of upright 102 with respect to tube hanger 1304 at a desired vertical position, so as to adjust the overall vertical position of storage system 100 on container wall 1400.

FIG. 16C illustrates a detailed view of two adjoined uprights 102 hung by tube hangers 1304 from support bar 1302, which is supported by hanger hook 1306, according to some embodiments. In a preferred embodiment, retainer plates 1508 are spaced horizontally apart from one another on a single hanger hook 1306 by a distance that is sufficient to receive the width of the top plate 1604 of two tube hangers 1304 positioned immediately adjacent to one another, as shown in FIG. 16C. This spacing accounts for variable positioning of suspension elements by installers of the system and for variability in corrugation configurations on the container wall, enabling continuous runs of shelving from multiple, adjacent shelving units regardless of those variabilities. As further shown in FIG. 16C, retainer plates 1508 may receive an optional fastener 1616, such as a threaded bolt or screw, that can be used to secure the retainer plates 1508 of the hanger hook 1306 to the support bar 1302, thus preventing relative movement between the retainer plates 1508 and the hanger hook 1306 when fastener 1616 is tightened.

As storage system 100 may be expanded as desired by adding one vertical section at a time, it may, in certain configurations, be desirable to at least temporarily join adjacent sections at adjacent uprights 102, for example, to maintain the full storage system 100 in a generally planar alignment.

Figure 17A:
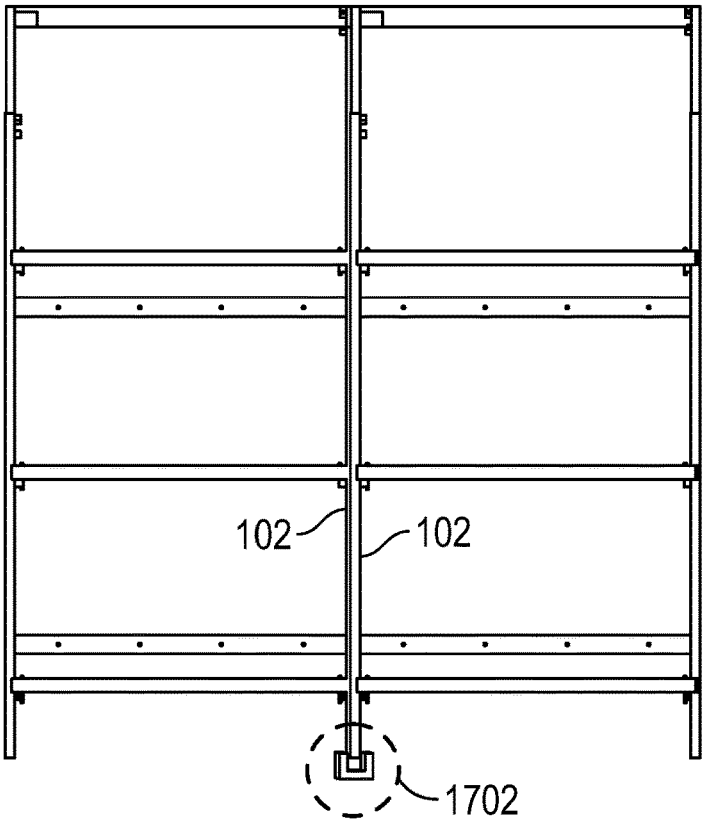
FIG. 17A illustrates modular sections of the storage system joined by a section connector, according to some embodiments.

FIG. 17A illustrates modular sections of storage system 100 joined by a section connector 1702, according to some embodiments. In one embodiment shown in FIG. 17A, section connector 1702 may join immediately adjacent uprights 102. Section connector 1702 may be in the form of a plastic insert having two joined rectangular blocks that may be inserted into the hollow bottom portions of two adjacent uprights 102 to hold the bottoms of those adjacent uprights 102 in a fixed position with respect to one another.

Figure 17B:
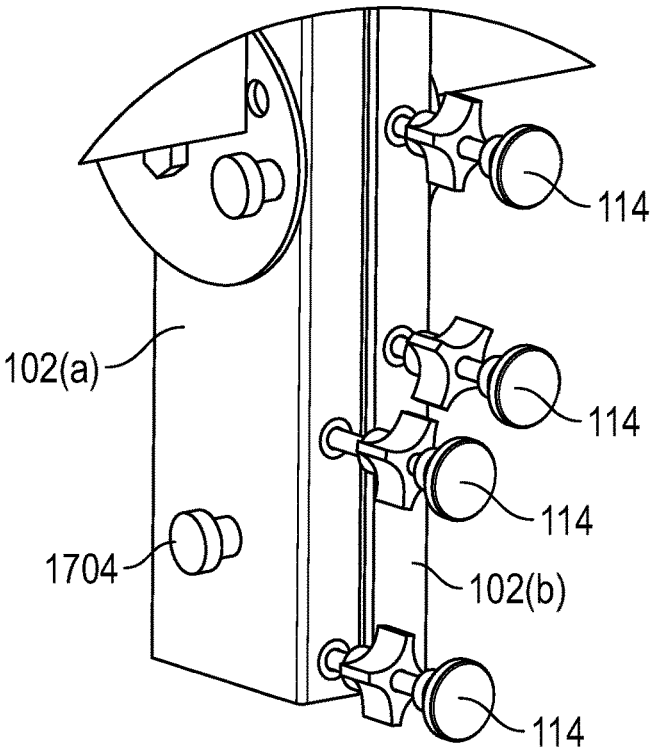
FIG. 17B illustrates modular sections of the storage system joined by one or more section fasteners, according to some embodiments.

Additionally, or alternatively, FIG. 17B illustrates modular sections of storage system 100 joined by one or more section fasteners 1704, according to some embodiments. Section fastener 1704, such as a threaded screw, bolt, or rod, may extend through the bottom of a first upright 102(*a*) and into a second upright 102(*b*) to hold the bottoms of those adjacent uprights 102(*a*) and 102(*b*) in a fixed position with respect to one another.

Section connector 1702 and/or section fastener 1704 may be used regardless of whether storage system 100 is floor-standing on a footer assembly 1202 (as shown in FIG. 6, for example) or is hung from a container wall 1400 by a support bar 1302 (as shown in FIG. 13, for example). As would be understood by a person having ordinary skill in the art, some uprights 102 may include a footer 1204 while some adjacent uprights may be connected by a section connector 1702 or section fastener(s) 1704, and further, some uprights 102 may alternatively stand on section connector 1702 instead of footer 1204.

In some embodiments of the storage system 100, if a footer 1204 is not used and a swivel leveling mount 114 is desired to support a hanging configuration of storage system 100 against a container wall 1400, variations of uprights 102 can be used to enable installation of a swivel leveling mount 114 in an upright 102 without a footer 1204. See, for example, FIG. 13, showing swivel leveling mount 114 threaded into a closed backside of upright 102. In some embodiments, swivel leveling mounts 114 may be adjustable in length, such as by screwing each swivel leveling mounts 114 into or away from uprights 102 to a desired length to achieve a preferred distance of each swivel leveling mount away from the container wall. Variations of and alternatives to swivel leveling mount 114 may also be installed on upright 102, such as is shown in FIGS. 18A and 18B.

Figure 18B:
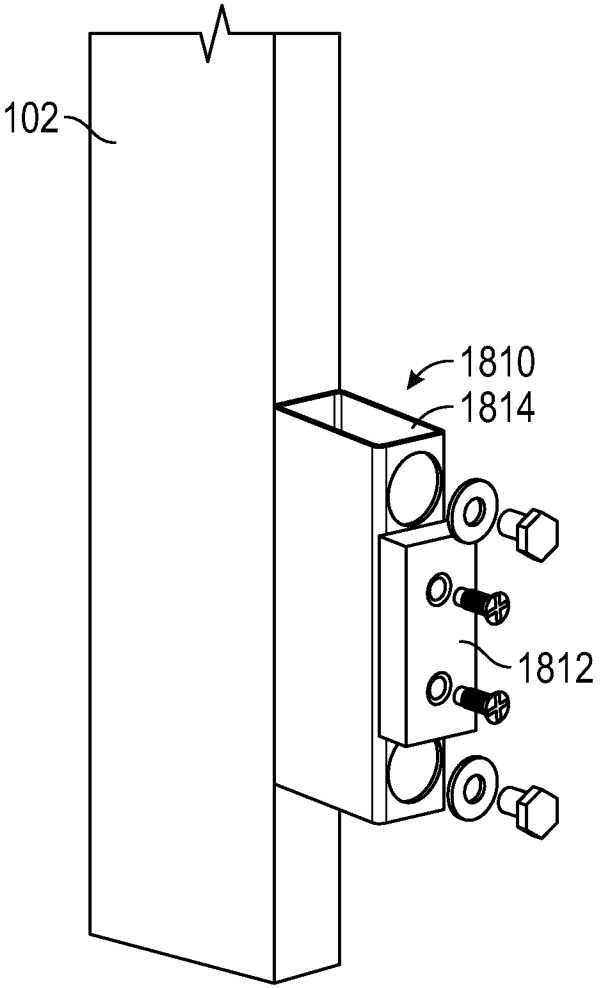
FIG. 18B illustrates a static magnetic mount installed on an upright of the storage system, according to some embodiments.
Figure 18A:
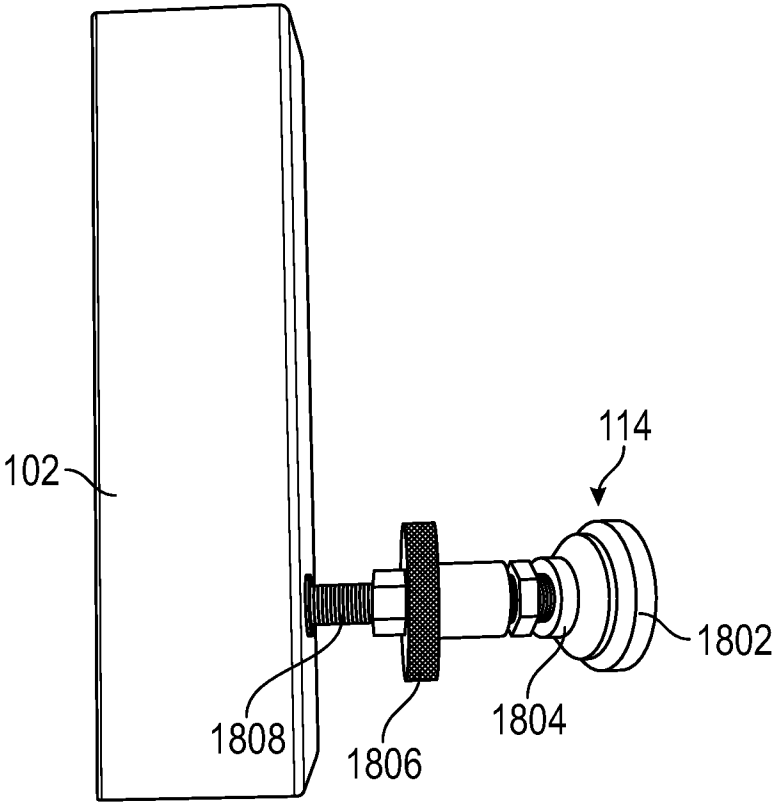
FIG. 18A illustrates a swivel leveling mount with an adjustable magnetic head, according to some embodiments.

FIG. 18A illustrates a swivel leveling mount 114 with an adjustable magnetic head 1802, according to some embodiments. Adjustable magnetic head 1802 may magnetically engage the container wall 1400 to prevent storage system 100 from inadvertently moving or swaying after it has been suspended from support bar 1302 inside of the container. As shown in FIG. 18A, the adjustable magnetic head 1802 of swivel leveling mount 114 may include a rubberized pad having an internal neodymium magnet affixed at the end of a swivel foot 1804, which swivel foot 1804 may be mounted to an adjustment knob 1806. Adjustment knob 1806 may likewise be rotatably mounted to a threaded stem 1808 that is rigidly affixed to upright 102, such that rotation of adjustment knob 1806 may vary the position of adjustable magnetic head 1802 as desired to maintain a desired distance between upright 102 and the container wall 1400.

In certain configurations, such swivel leveling mounts 114 may be provided at both the top and bottom regions of the back sides of upright 102. For example, with further reference to FIG. 17B, the placement of swivel leveling mounts 114, including those with adjustable magnetic head 1802 as shown in FIG. 18A, may be provided in staggered (i.e., not side-by-side) locations on the back sides of two adjacent uprights 102(*a*) and 102(*b*) so that each may be easily accessed and adjusted without interference from swivel leveling mounts 114 on the adjacent upright 102.

As an alternative to swivel leveling mount 114, FIG. 18B illustrates a static magnetic mount 1810 installed on upright 102 of storage system 100, according to some embodiments. As shown in FIG. 18B, static magnetic mount 1810 may comprise a rubber coated neodymium magnet 1812 mounted to a mounting block 1814 on the back side of upright 102.

As another alternative to, or in addition to, swivel leveling mounts 114 and/or static magnetic mount 1810, and referring again to FIGS. 13 and 14A, a bottom-most stabilizer bar 1414 may optionally be provided (in addition to or in place of cross brace 2102) with one or more magnets 1416 affixed on a back side of the stabilizer bar 1414. By way of non-limiting example, the one or more magnets 1416 is/are preferably comprised of neodymium and is/are preferably encapsulated with rubber covers and positioned to land on the vertical outer face 1404 of the corrugated wall of the container, adding a stability function to the storage system 100. In at least one embodiment, the one or more magnets 1416 is/are located on the stabilizer bar 1414 such that contact is assured with vertical outer face(s) 1404 while uprights 102 having tube hangers 1304 are placed within the vertical channels 1402 of the corrugated wall of the container.

As previously discussed in reference to FIGS. 1, 3, 8, 9A, 9B, 10A-10D, and 11, for example, some embodiments of storage system 100 may have shelves 116 mounted on top of shelf supports 118 such that the shelves 116 are mounted forward of uprights 102 (see, specifically, area 120 in FIG. 1). In another embodiment, shelf supports 118 may optionally be positioned inside of the perimeter of shelf 116 such that the shelves 116 are mounted further back, within uprights 102, and notched (as shown in FIG. 19) to accommodate the uprights 102 (contrast, specifically, area 1902 in FIG. 13).

Figure 19:
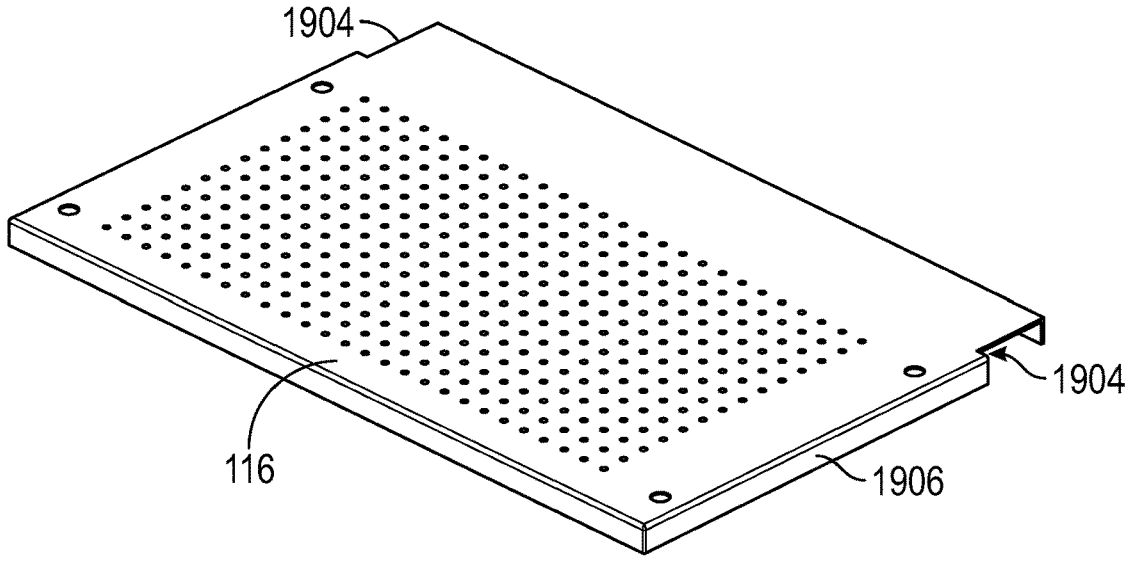
FIG. 19 illustrates a notched shelf of the storage system, according to some embodiments.

FIG. 19 illustrates a notched shelf 116 of the storage system 100, according to some embodiments. As shown in FIG. 19, a notch 1904 may be provided along the side wall 1906 toward the back end of each shelf 116. Notch 1904 allows a back portion of shelf 116 to extend between a pair of uprights 102 when positioned horizontally, while the remaining forward portion of shelf 116 may have a wider dimension to overlap at least a portion of the front face of each upright 102. Shelves 116 and shelf supports 118 may otherwise operate in the same manner as discussed above with respect to FIGS. 1, 3, 8, 9A, 9B, 10A-10D, and 11, for example, regardless of the notched configuration.

Figure 20:
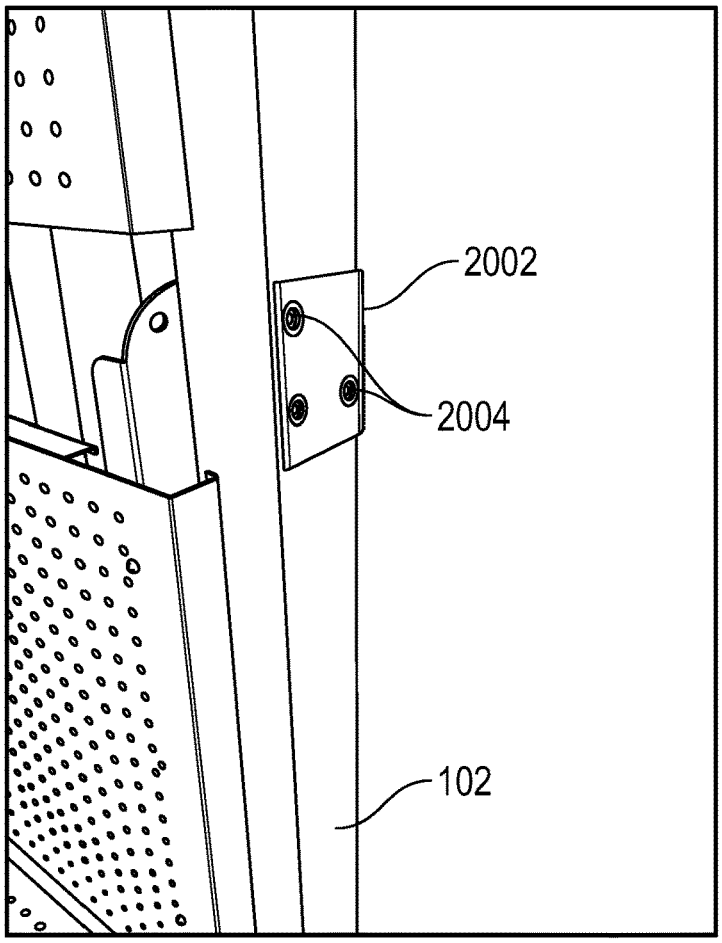
FIG. 20 illustrates a friction plate between an outer face of each shelf support and an upright to which it is pivotably attached, according to some embodiments.

FIG. 20 illustrates a friction plate 2002 (formed, by way of non-limiting example, of nylon) that may optionally be provided between an outer face of each shelf support 118 and the upright 102 to which it is pivotably attached, according to some embodiments. Such friction plate 2002 provides a generally planar surface over which shelf supports 118 may slide as they pivot. Friction plate 2002 may be secured by fasteners such as rivet nuts 2004.

Figure 21:
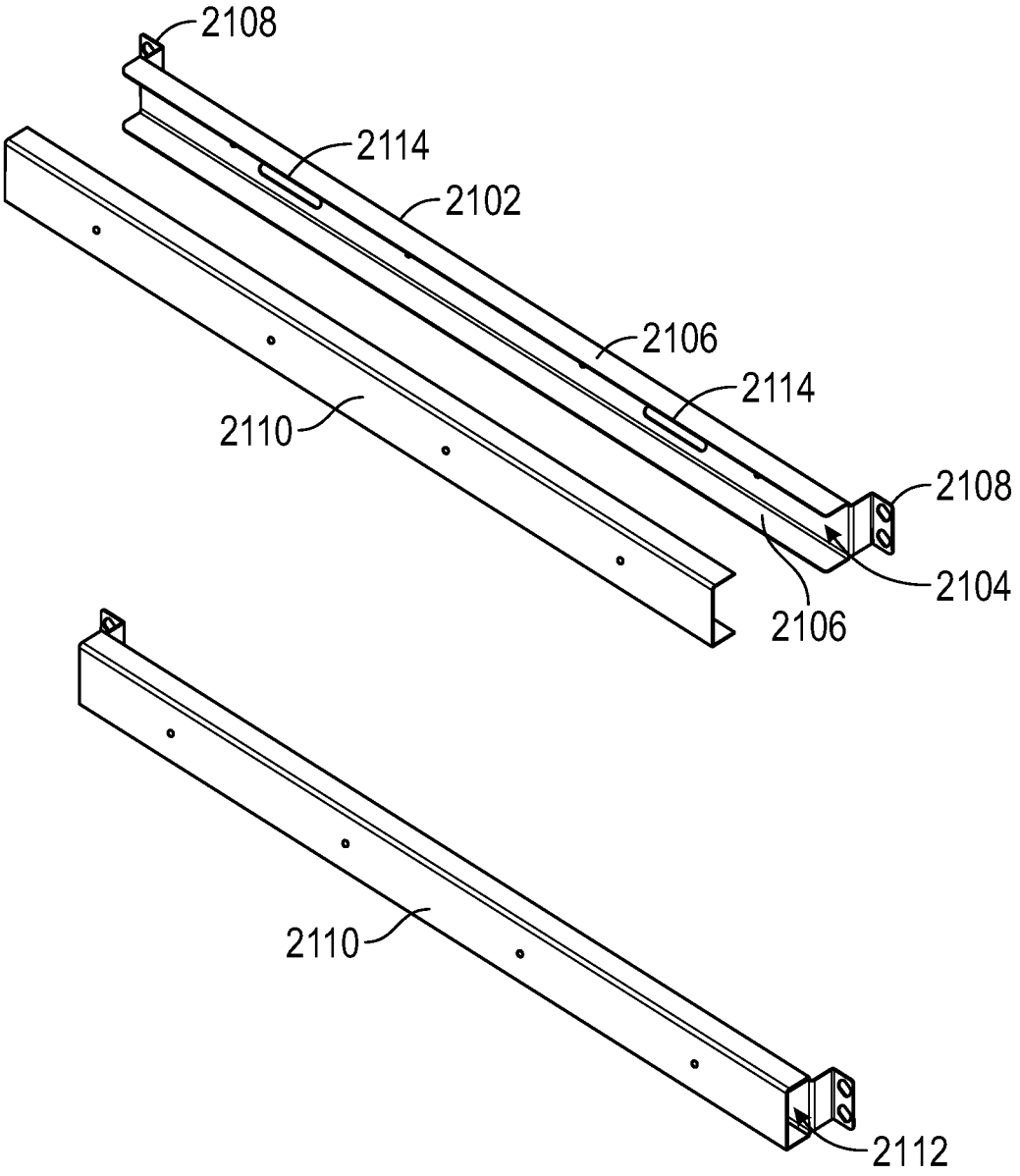
FIG. 21 illustrates another configuration of a cross brace for the storage system, according to some embodiments.

FIG. 21 illustrates another configuration of a cross brace 2102 (as an alternative to cross brace 104) for the storage system 100 shown in FIG. 13, according to some embodiments. As shown in FIG. 13, cross brace 2102 may extend between the interiorly facing side edges of a pair of uprights 102. Similar to cross brace 104 in FIG. 6, cross brace 2102 may include an open channel 2104 having flanges 2106 to provide access to any wires, cabling, or other items extending through open channel 2104. However, in this configuration, access to channel 2104 for wire management can be from the front of storage system 100 as the system hangs against a container wall 1400, for example. Additionally, each cross brace 2102 preferably includes tabs 2108 for affixing an end of each cross brace 2102 to a back side of each upright 102, while positioning channel 2104 so that it extends between interiorly facing sides of a pair of uprights 102. Preferably, a removeable, elongate plastic cover 2110 may be placed over open channel 2104 of cross brace 2102 to contain any wires, cabling, or other items within channel 2104 such that the space becomes a closed channel 2112. Likewise, cross brace 2102 may include wire cut-outs 2114 enabling the passing of cabling, such as a power cable, from a rear of the cross brace 2102 into its open channel 2104 at one or more intermediate locations along the length of cross brace 2102. As with the configuration discussed above with respect to FIGS. 6 and 13, uprights 102 may have openings to enable wires and the like to pass from one channel 2104 between a first pair of uprights 102 to an adjacent channel 2104 between a second, adjacent pair of uprights.

Having now fully set forth the preferred embodiments and certain modifications of the concept underlying the present disclosure, various other embodiments as well as certain variations and modifications of the embodiments herein shown and described will obviously occur to those skilled in the art upon becoming familiar with said underlying concept. It should be understood, therefore, that aspects of this disclosure may be practiced otherwise than as specifically set forth herein.

What is claimed is:

1. A storage system configured for suspension from a plurality of fixed points on a vertical wall, the storage system comprising:

a plurality of hanger hooks, wherein each one of said plurality of hanger hooks comprises:

a planar hook base comprising a front side and a back side, retainer plates extending from the front side of the planar hook base, the retainer plates spaced apart across a gap, and a hook arm comprising:

a first portion extending from the back side of the planar hook base, the first portion aligned with the gap across the planar hook base; and a second portion centered on the planer hook base under the gap and configured to contact the vertical wall, and wherein each one of said plurality of hanger hooks is configured for removable engagement with one of said plurality of fixed points on the vertical wall;

a support bar configured to be positioned on said planar hook base of each of said plurality of hanger hooks; and a plurality of vertical uprights, each of said plurality of vertical uprights having a support bar hook configured for vertically suspending said each of said plurality of vertical uprights from the support bar.

2. The storage system of claim 1, further comprising a plurality of pivotable support arms coupled to each of said vertical uprights at vertically spaced positions to allow pivoting of each of said plurality of pivotable support arms, said plurality of pivotable support arms configured to support a plurality of shelves, wherein each of said plurality of pivotable support arms is configured to pivot into a plurality of independent lockable positions, wherein said plurality of independent lockable positions comprises horizontal, vertical, and upwardly angled.

3. The storage system of claim 2, wherein each of said plurality of pivotable support arms is configured to receive connectors to affix a planar surface to two adjacent parallel support arms of said plurality of pivotable support arms, wherein at least one of said plurality of shelves is coupled between two of said plurality of vertical uprights and affixed as the planar surface.

4. The storage system of claim 2, further comprising at least one shelf of said plurality of shelves, wherein the at least one shelf is comprised of pegboard configured to hold items when said at least one shelf is locked into a vertical position.

5. The storage system of claim 2, wherein at least one of said plurality of pivotable support arms is pivotably affixed to one of said plurality of vertical uprights with a fixed-position pivot pin, said fixed-position pivot pin comprising:

a head;

a first ring extending outward from said head;

a second ring extending outward from said first ring and having a smaller diameter than said first ring; and a threaded shaft extending outward from said second ring, said threaded shaft engaging a threaded member positioned on an interior of said one of said plurality of vertical uprights.

6. The storage system of claim 1, wherein each of said plurality of vertical uprights is configured to receive a tube hanger slidably mounted at a top of each said vertical upright for telescopic movement into and out of each said vertical upright, wherein said support bar hook is affixed to a top of said tube hanger.

7. The storage system of claim 6, wherein said tube hanger is independently positionable along said support bar.

8. The storage system of claim 1, further comprising at least one swivel foot adjustably mounted to a back of one of said plurality of vertical uprights and configured to provide support for said one of said plurality of vertical uprights against the vertical wall at a variable horizontal distance.

9. The storage system of claim 1, further comprising a plurality of cross braces, each cross brace horizontally extending between two adjacent vertical uprights of said plurality of vertical uprights and configured to hold said two adjacent vertical uprights at a fixed distance from each other, wherein at least one of said plurality of cross braces and each of said two adjacent vertical uprights are configured to define a path for routing of wires or cables among said at least one of said plurality of cross braces and said two adjacent vertical uprights.

10. The storage system of claim 9, further comprising independently movable storage sections each comprising two of said plurality of vertical uprights, at least one cross brace of said plurality of cross braces horizontally connecting the top of said two vertical uprights, and at least a second one of said plurality of cross braces horizontally connecting the bottom of said two vertical uprights.

11. The storage system of claim 10, further comprising a section connector configured to hold two of said independently movable storage sections in a fixed position with respect to one another.

12. The storage system of claim 10, wherein one of said independently movable storage sections is laterally positioned along said vertical wall at a location that is independent of any of said plurality of fixed points of said vertical wall.

13. The storage system of claim 9, wherein at least one of said plurality of cross braces is a stabilizer bar comprising at least one magnet affixed to said stabilizer bar to hold said storage system against an outer corrugation of a metal corrugated wall of a shipping container.

14. The storage system of claim 1, further comprising a footer coupled to the bottom of at least one of said plurality of vertical uprights, said footer configured to contact a floor below the storage system.

15. The storage system of claim 1, further comprising the plurality of fixed points, wherein each of said plurality of fixed points on said vertical wall further comprises a rigid loop affixed along a top edge of said vertical wall.

16. The storage system of claim 15, further comprising the vertical wall, wherein said vertical wall is a corrugated wall of a shipping container.

17. The storage system of claim 16, wherein each of said plurality of hanger hooks is independently moveable and is configured for suspension from said rigid loop.

18. The storage system of claim 1, wherein the retainer plates are affixed to said planar hook base and positioned to hold said support bar on said planar hook base between said one or more retainer plates and said hook arm.

19. The storage system of claim 1, wherein:

the second portion of the hook arm forms a quadrant of a circle, a portion of the quadrant configured to contact the vertical wall.

20. The storage system of claim 1, wherein:

the front side of the planar hook base is longer than the back side of the planar hook base such that the planar hook base fits in a vertical channel of the vertical wall.

21. The storage system of claim 1, wherein each of the retainer plates includes an aperture centered on the respective retainer plate, the aperture configured to receive a fastener, the fastener configured to couple the support bar to the hanger hook.

* * * * *